US010265752B2

(12) United States Patent
Otsuka et al.

(10) Patent No.: US 10,265,752 B2
(45) Date of Patent: Apr. 23, 2019

(54) METHOD FOR MANUFACTURING PRESS-FORMED PRODUCT AND PRESS-FORMING APPARATUS

(71) Applicant: NIPPON STEEL & SUMITOMO METAL CORPORATION, Tokyo (JP)

(72) Inventors: Kenichiro Otsuka, Tokyo (JP); Yoshiaki Nakazawa, Tokyo (JP); Ryuichi Nishimura, Tokyo (JP); Yasuhiro Ito, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 499 days.

(21) Appl. No.: 14/913,575

(22) PCT Filed: Sep. 10, 2014

(86) PCT No.: PCT/JP2014/073972
§ 371 (c)(1),
(2) Date: Feb. 22, 2016

(87) PCT Pub. No.: WO2015/053036
PCT Pub. Date: Apr. 16, 2015

(65) Prior Publication Data

US 2016/0199897 A1 Jul. 14, 2016

(30) Foreign Application Priority Data

Oct. 9, 2013 (JP) ..... 2013-212073

(51) Int. Cl.
*B21D 5/16* (2006.01)
*B21D 22/02* (2006.01)
(Continued)

(52) U.S. Cl.
CPC ..... *B21D 22/02* (2013.01); *B21D 5/16* (2013.01); *B21D 22/26* (2013.01); *B21D 22/24* (2013.01)

(58) Field of Classification Search
CPC ..... B21D 22/20; B21D 22/21; B21D 22/22; B21D 22/24; B21D 22/26; B21D 24/00;
(Continued)

(56) References Cited

U.S. PATENT DOCUMENTS 4,309,888 A * 1/1982 Miller ..... B65D 1/26 72/334
4,398,984 A * 8/1983 Uchiyama ..... B60J 5/042 156/196
(Continued)

FOREIGN PATENT DOCUMENTS

DE 10 2004 018 897 A1 11/2005
EP 2 716 525 A1 4/2014
(Continued)

OTHER PUBLICATIONS

Machine translation of FR 2673127, Translated Jan. 9, 2018, 3 Pages.*
(Continued)

*Primary Examiner* — Teresa M Ekiert
*Assistant Examiner* — Gregory D Swiatocha
(74) *Attorney, Agent, or Firm* — Birch, Stewart, Kolasch & Birch, LLP

(57) ABSTRACT

In forming a press-formed product that is made of a high-tensile steel sheet having a tensile strength of 390 MPa or more, and has a substantially gutter-shaped cross section and an outward continuous flange, wrinkling in ridges and cracking in the outward continuous flange are reduced. A method for manufacturing a press-formed product that is made of a high-tensile steel sheet of 390 MPa or more, and
(Continued)

has a substantially gutter-shaped cross section and an outward continuous flange in at least one end in a predetermined direction includes a first step in which, after a first pad restrains at least a part of a portion to be formed into a gutter bottom in a forming material, a second pad restrains at least a part of the end of portions to be formed into ridges and subsequently carries out press forming.

9 Claims, 18 Drawing Sheets

(51) Int. Cl.
*B21D 22/24* (2006.01)
*B21D 22/26* (2006.01)

(58) Field of Classification Search
CPC ..... B21D 24/04; B21D 24/06; B21D 24/08; B21D 24/10; B21D 24/12
USPC ..... 72/347–351
See application file for complete search history.

(56) References Cited

U.S. PATENT DOCUMENTS

| | | | | |
|---|---|---|---|---|
| 4,483,171 | A * | 11/1984 | Franek | B21D 22/26 72/347 |
| 2012/0297853 | A1* | 11/2012 | Tanaka | B21D 22/02 72/350 |
| 2012/0324974 | A1* | 12/2012 | Nakamura | B21D 22/22 72/305 |
| 2014/0144560 | A1 | 5/2014 | Yamano et al. | |
| 2015/0061323 | A1 | 3/2015 | Otsuka et al. | |
| 2015/0174634 | A1 | 6/2015 | Nishimura et al. | |
| 2015/0367392 | A1 | 12/2015 | Nishimura et al. | |

FOREIGN PATENT DOCUMENTS

| | | | | |
|---|---|---|---|---|
| FR | 2673127 | A1 * | 8/1992 | B21D 22/22 |
| FR | 2673127 | A1 | 8/1992 | |
| JP | 5-23761 | A | 2/1993 | |
| JP | 2009-255116 | A | 11/2009 | |
| JP | 4438468 | B2 | 3/2010 | |
| JP | 2012-51005 | A | 3/2012 | |
| JP | 2013-174004 | A | 9/2013 | |
| JP | 5569661 | B2 | 8/2014 | |
| WO | WO 2012/160697 | A1 | 11/2012 | |
| WO | WO 2013/154114 | A1 | 10/2013 | |
| WO | WO 2014/148618 | A1 | 9/2014 | |

OTHER PUBLICATIONS

Extended European Search Report dated Apr. 6, 2017, for corresponding Application No. 14852088.5.
Canadian Office Action dated May 31, 2017, issued in Canadian Patent Application No. 2,920,881.
International Search Report, issued in PCT/JP2014/073972, dated Nov. 4, 2014.
Written Opinion of the International Searching Authority, issued in PCT/JP2014/073972 (PCT/ISA/237), dated Nov. 4, 2014.
Office Action dated Oct. 8, 2018 in corresponding Indonesian Patent Application No. P00201602116, with English translation.

* cited by examiner (a)

(b)

(a)

(b)

(a)

(b)

(a)

COMPARATIVE EXAMPLE 3

(b)

COMPARATIVE EXAMPLE 4

(c)

EXAMPLE 2

(a)

(b)

(a)
COMPARATIVE EXAMPLE 3

(b)
COMPARATIVE EXAMPLE 4

(c)
EXAMPLE 2

(a)
COMPARATIVE EXAMPLE 3

(b)
COMPARATIVE EXAMPLE 4

(c)
EXAMPLE 2

(a)
COMPARATIVE
EXAMPLE 3

(b)
COMPARATIVE
EXAMPLE 4

(c)
EXAMPLE 2

(a)
COMPARATIVE EXAMPLE 3

(b)
COMPARATIVE EXAMPLE 4

(c)
EXAMPLE 2

METHOD FOR MANUFACTURING PRESS-FORMED PRODUCT AND PRESS-FORMING APPARATUS

TECHNICAL FIELD

The present invention relates to a method for manufacturing a press-formed product and a press-forming apparatus. More particularly, the present invention relates to a method for manufacturing a press-formed product that is made of a high-tensile steel sheet having a tensile strength of 390 MPa or more and has a substantially gutter-shaped cross section, and to a press-forming apparatus to be used for manufacturing the press-formed product.

BACKGROUND ART

The floor of an automotive body (hereinafter simply referred to as "floor") has rigidity to primarily resist the torsion and bending of the vehicle body when driving the vehicle, and also transfers an impact load in a case of collision of the vehicle. The floor also affects a weight of the automotive body significantly. Accordingly, the floor is required to have mutually contradicting properties, that is, a high rigidity and a lightweight. The floor includes flat panels that are joined to each other by welding, vehicle widthwise members that have substantially gutter-shaped cross sections and are fixed to the flat panels along the vehicle widthwise direction, and vehicle longitudinal members that have substantially gutter-shaped cross sections and are fixed to the flat panels along the front-back direction of the vehicle body.

The flat panels include, for example, a dash panel, a front floor panel, a rear floor panel, and the like. The vehicle widthwise members are members fixed by welding and disposed along the vehicle widthwise direction of these flat panels to increase the rigidity and strength of the floor. The vehicle widthwise members include, for example, floor cross members, seat cross members, and the like. The vehicle longitudinal members are members fixed by welding and disposed along the front-back direction of an automotive body to increase the rigidity and strength of the floor. The outward flangevehicle longitudinal members include, for example, side sills, side members, and the like. Among them, reinforcing members such as the vehicle widthwise members and the vehicle longitudinal members are typically joined to other members via outward flanges formed at ends of the reinforcing members. For example, a floor cross member, which is an example of the vehicle widthwise members, is joined to the tunnel portion of a front floor panel and to a side sill via outward flanges that are formed at both ends of the floor cross member.

FIGS. 19 (*a*) and 19 (*b*) illustrate a floor cross member 1, which is a representative example of a member joined to other members with outward flanges 4 formed at both ends in the longitudinal direction of the member. FIG. 19 (*a*) is a perspective view of the floor cross member 1 and FIG. 19 (*b*) is a view on the arrow A in FIG. 19 (*a*).

A front floor panel 2 is reinforced, for example, by a tunnel portion (not shown) that is joined to the upper surface (indoor-side surface) of the front floor panel 2, and also by a side sill 3 and the floor cross member 1. The tunnel portion is a structural member projecting toward the inside of a vehicle along the substantially widthwise center of the front floor panel 2. The side sill 3 is spot welded to the upper surface of the front floor panel 2 at each widthwise edge of the front floor panel 2. Both ends of the floor cross member 1 are spot welded to the tunnel portion and the side sill 3 with the outward flanges 4 formed at both ends in the longitudinal direction. This improves the rigidity of the floor and the load transfer property when an impact load is applied.

As described above, the floor cross member 1 is an important structural member to perform a function to improve the rigidity of an automotive body and to absorb an impact load in a case of a lateral collision event. Accordingly, in an aim to reduce body weight and improve collision safety, a high-tensile steel sheet of smaller thickness and larger strength, such as, for example, a high-tensile steel sheet having a tensile strength of 390 MPa or more (high-strength steel sheet or high-tensile strength steel sheet), has been used as a material for the floor cross member 1 in recent years. However, there is still a strong demand for a floor cross member 1 that has more improved load transfer property when an impact load is applied. To address the demand, it is necessary to improve the load transfer property when an impact load is applied, not only by increasing the material strength alone but also by modifying the shape of the floor cross member 1.

Although Patent Literatures 1 to 3 do not intend to form a floor cross member, Patent Literatures 1 to 3 disclose inventions to solve defects in shape fixation of press-formed products made of high strength materials by modifying pad mechanisms used with dies. These inventions have attempted to make an improvement in the shape fixability after press forming by intentionally generating deflection of a material during forming depending on the positional relationship between the top of a punch and a flat pad of only a part that faces a flat part of the top of the punch.

PRIOR ART LITERATURE

Patent Literatures

[Patent Literature 1] JP 4438468B
[Patent Literature 2] JP 2009-255116A
[Patent Literature 3] JP 2012-051005A

SUMMARY OF INVENTION

Problem(s) to be Solved by the Invention

In order to increase the floor rigidity and the load transfer property of the floor when an impact load is applied, it is preferable that the outward flanges formed at both ends of the floor cross member are made continuous and joined to members such as the tunnel portion of the floor front panel and the side sill. In other words, it is preferable, as will be described later, that the outward flanges are formed also in the ends in the longitudinal direction of ridges of the floor cross member, and are made continuous along at least a gutter bottom and the ridges. Incidentally, the term "outward flange" as used herein refers to a flange formed in the way that an end of a formed product having a substantially gutter-shaped cross section is bent outwardly from the gutter, and the term "outward continuous flange" refers to an outward flange that is continuously formed along at least the ridges and the gutter bottom.

However, when forming the outward continuous flange including the ends of the ridges by using press forming, such forming of the outward flange to be formed in the ends of the ridges becomes stretched flange forming, which tends to cause cracking in the edges of the outward flange. In addition, when forming the outward continuous flange, which includes the ends of the ridges, by using press forming, wrinkling tends to occur near the base of the flanges 1*b* formed in the vicinity of the ends of the ridges. These defects during press forming occur more often as the material strength of the press-formed product becomes higher. Moreover, these defects occur more often as a stretch flanging rate during flange forming in the ends of the ridges becomes larger, in other words, as the angle θ between the gutter bottom 1*c* and each vertical wall 1*d* in FIG. 19 (*b*) becomes smaller. Furthermore, these defects occur more often as the height h of the press-formed product in FIG. 19 (*b*) becomes larger, because more tension in the outward flange is produced.

There is a tendency that reinforcing members such as vehicle widthwise members and vehicle longitudinal members are more strengthened as an automotive body becomes lighter. In addition, such reinforcing members tend to be designed to have a shape in which the stretch flanging rate becomes larger in forming the outward continuous flange, due to property requirements and a shape of a joint for joining to another member. In these circumstances, press forming methods known in the art have had a difficulty in reducing cracking in the outward continuous flange and wrinkling in the vicinity of the ends of the ridges. Accordingly, due to the press forming constraints, notches have to be provided, by sacrificing properties of a reinforcing member, at regions corresponding to ends of the ridges in the outward flange formed in an end of the reinforcing member made of the high-tensile steel sheet. In other words, the outward flange 4 has to be discontinuous due to notches 4*a* formed in the regions of the ends of the ridges 1*a* as illustrated in FIG. 19 (*a*) and FIG. 19 (*b*).

Furthermore, the phrase "provide a notch in a flange" as used herein is meant to provide a notch formed in the whole width direction of the flange, which makes the flange discontinuous. The term "the width of a flange" is used to have the same meaning as the height of the flange. When the width of the flange is made small partially but a part of the flange still remains, the notch is not meant to be provided in the flange.

With each of the known inventions disclosed in Patent Literatures 1 to 3, it is difficult to form a desired outward continuous flange along at least a gutter bottom and ridges in the end of the press-formed product that is made of a high-tensile steel sheet having a tensile strength of 390 MPa or more and that has a gutter bottom, ridges, and vertical walls that make a substantially gutter-shaped cross section. Therefore, when the press-formed product having an outward flange is formed according to the known inventions disclosed by Patent Literatures 1 to 3, it is necessary to provide the notches in the regions in the ends of the ridges. That is to say, when using the known inventions disclosed in Patent Literatures 1 to 3, the press-formed products having the outward flange cannot be formed without lowering the production yield of the press-formed products to be obtained.

An object of the present invention is to provide a method for manufacturing a press-formed product and a press-forming apparatus, which can reduce cracking in the edge of the outward continuous flange and wrinkling near the base of the flange in the vicinity of the ends of the ridges in forming the press-formed product that is made of a high-tensile steel sheet having a tensile strength of 390 MPa or more and that has a substantially gutter-shaped cross section and an outward continuous flange.

Means for Solving the Problem(s)

In order to solve the above described problem, according to an aspect of the present invention, there is provided a method of manufacturing a press-formed product by press forming a forming material made of a high-tensile steel sheet of 390 MPa or more, the press-formed product extending in a predetermined direction, having a substantially gutter-shaped cross section intersecting the predetermined direction, and including a gutter bottom, a ridge continuing to the gutter bottom, a vertical wall continuing to the ridge, and an outward continuous flange being continuously formed along at least the gutter bottom and the ridge in at least one end in the predetermined direction, the method including: a first step in which, by using a first press-forming apparatus including a first punch, a first die, a first pad, and a second pad, the both pads facing the first punch, the first pad presses at least a part of a portion to be formed into the gutter bottom in the forming material to press the forming material against the first punch in a manner that an end of the forming material continuing to the portion to be formed into the gutter bottom is raised in a direction opposite to the pressing direction and at least a part of the portion to be formed into the gutter bottom is restrained by the first pad and the first punch, and the second pad subsequently presses at least a part of an end in the predetermined direction in a portion to be formed into the ridge against the first punch in a manner that the end in the predetermined direction continuing to the portion to be formed into the ridge is raised in the direction opposite to the pressing direction and the portion to be formed into the ridge is bent in the pressing direction, and simultaneously, at least the part of the portion to be formed into the ridge is restrained by the second pad and the first punch, and the first punch and the first die carry out press forming to form an intermediate product while the forming material is restrained by the first pad and the second pad; and a second step in which, by using a second press-forming apparatus including a second punch and a second die, the second punch and the second die press form the intermediate product to form the press formed product.

In the first step, the second pad may press, against the first punch, a portion of at least ⅓ length of a perimeter of a cross section in the portion to be formed into the ridge starting from a border between the portion to be formed into the ridge and the portion to be formed into the gutter bottom.

The first pad and the second pad may be supported by the first die, and the first pad, the second pad, and the first die may consecutively press the forming material in this order while the first die is moved toward the first punch.

The press forming in the first step may be bending forming.

The press forming in the first step may be deep drawing.

The press-formed product may be a formed product in which at least one of width of the gutter bottom and height of the vertical wall gradually increases toward an end having the outward continuous flange.

In order to solve the above described problem, according to another aspect of the present invention, there is provided a press-forming apparatus used for manufacturing a press-formed product extending in a predetermined direction, having a substantially gutter-shaped cross section intersecting the predetermined direction, and including a gutter bottom, a ridge continuing to the gutter bottom, a vertical wall continuing to the ridge, and an outward continuous flange being continuously formed along at least the gutter bottom and the ridge in at least one end in the predetermined direction, the press-forming apparatus including: a punch; a die; and a pad facing the punch, the punch and the die carrying out press forming while a forming material made of a high-tensile steel sheet of 390 MPa or more is restrained by the pad and the punch. The pad includes a first pad, and a second pad being different from the first pad. The first pad presses and restrains at least a part of a portion to be formed into the gutter bottom in the forming material against the punch. The second pad presses at least a part of an end in a portion to be formed into the ridge against the punch in a manner that the portion to be formed into the ridge is bent in the pressing direction and at least the part of the portion to be formed into the ridge is simultaneously restrained. The second pad restrains at least the part of the portion to be formed into the ridge after the first pad restrains at least a part of the portion to be formed into the gutter bottom.

The second pad may press a portion of at least ⅓ length of a perimeter of a cross section in the portion to be formed into the ridge starting from a border between the portion to be formed into the ridge and the portion to be formed into the gutter bottom.

The first pad and the second pad may be supported by the die, and the first pad, the second pad, and the die may consecutively press the forming material in this order while the die is moved toward the punch.

Effect(s) of the Invention

According to the present invention, the portion to be formed into the gutter bottom is restrained by the first pad, and then the ends of the portions to be formed into the ridges are restrained by the second pads. Subsequently, the die and punch carry out press forming. Thereby, the movement (drawing-in) of the steel sheet material is reduced during press forming so that cracking in the edges of the outward continuous flange and wrinkling near the base of the flange in the vicinity of the ends of the ridges are reduced. Accordingly, the press-formed product, which is made of a high-tensile steel sheet having a tensile strength of 390 MPa or more and has a substantially gutter-shaped cross section and an outward continuous flange along at least the gutter bottom and the ridges in the ends, can be manufactured without providing the notches in the flanges and without lowering the production yield. The present invention is especially effective in forming press-formed products in which at least one of the width of a gutter bottom and the height of a vertical wall gradually increases toward the end that has an outward continuous flange.

BRIEF DESCRIPTION OF THE DRAWING(S)

Figure 3:
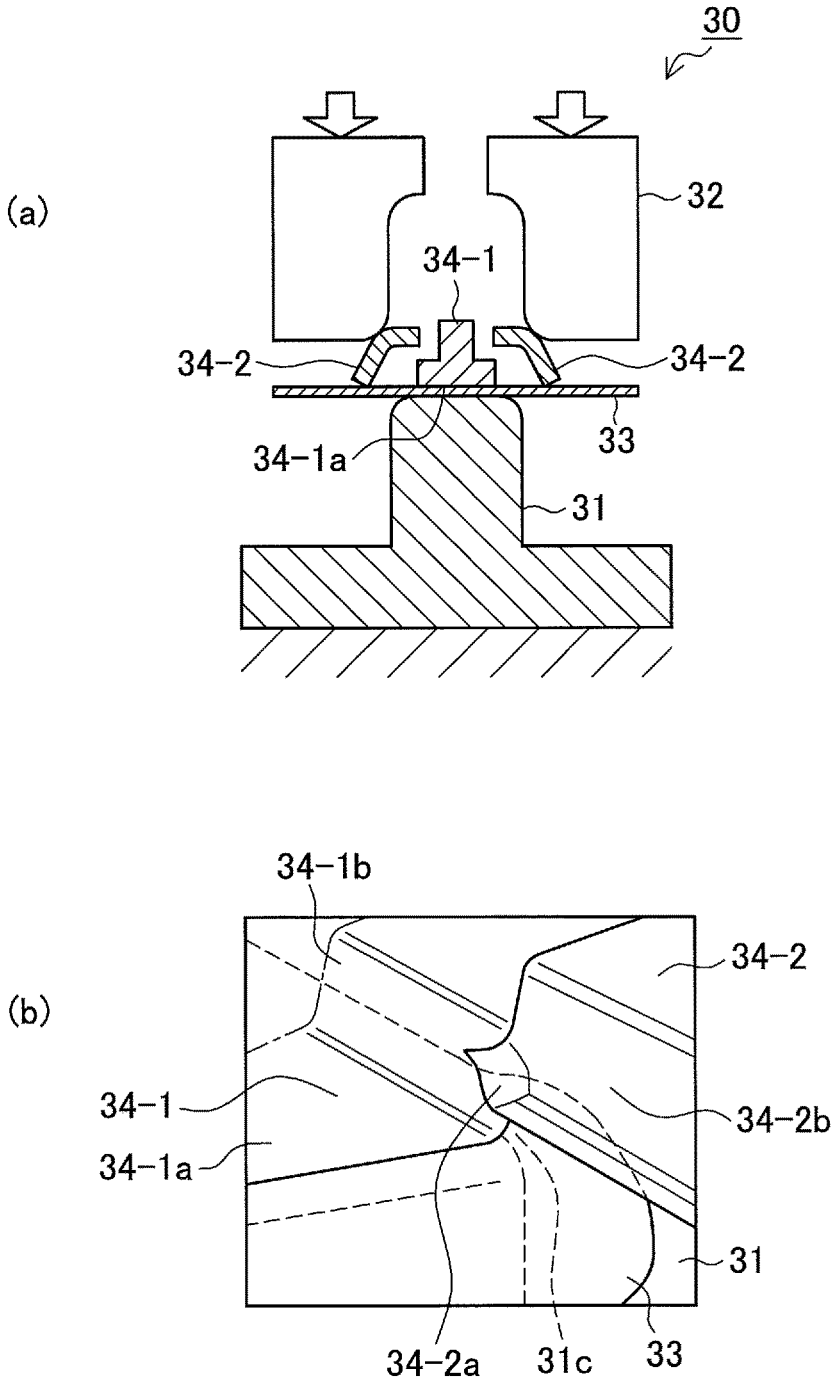

FIG. 3 (*a*) and FIG. 3 (*b*) are a cross sectional view and a perspective view illustrating a state in which a first pad restrains a portion to be formed into a gutter bottom.

Figure 4:
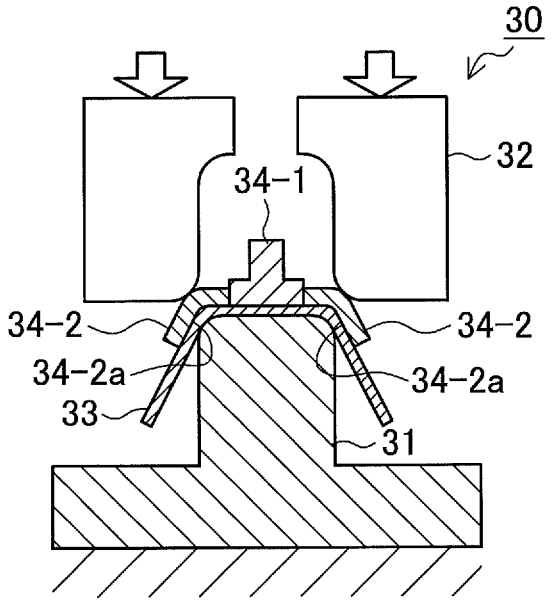
Figure 4:
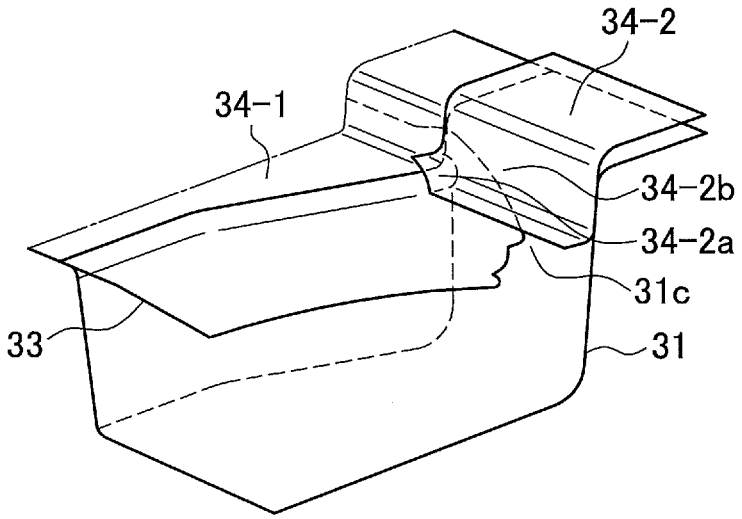

FIG. 4 (*a*) and FIG. 4 (*b*) are a cross-sectional view and a perspective view illustrating a state in which a second pad restrains portions to be formed into ridges.

Figure 5:
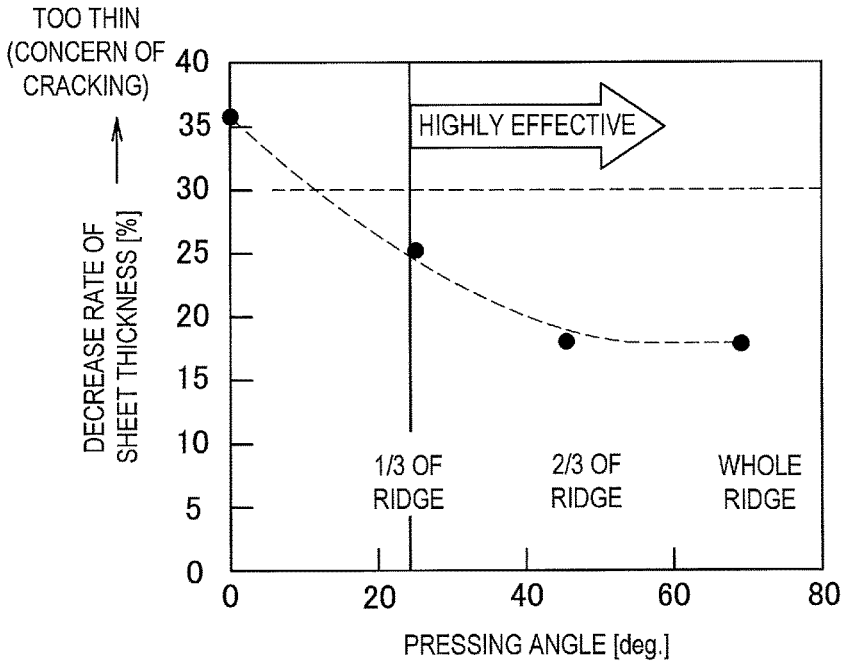

FIG. 5 is a characteristic diagram illustrating a relationship between an extent pressed by a second pad in a portion to be formed into a ridge and a minimum value of a decrease rate of sheet thickness in the edge of a flange in an end of a ridge.

Figure 6:
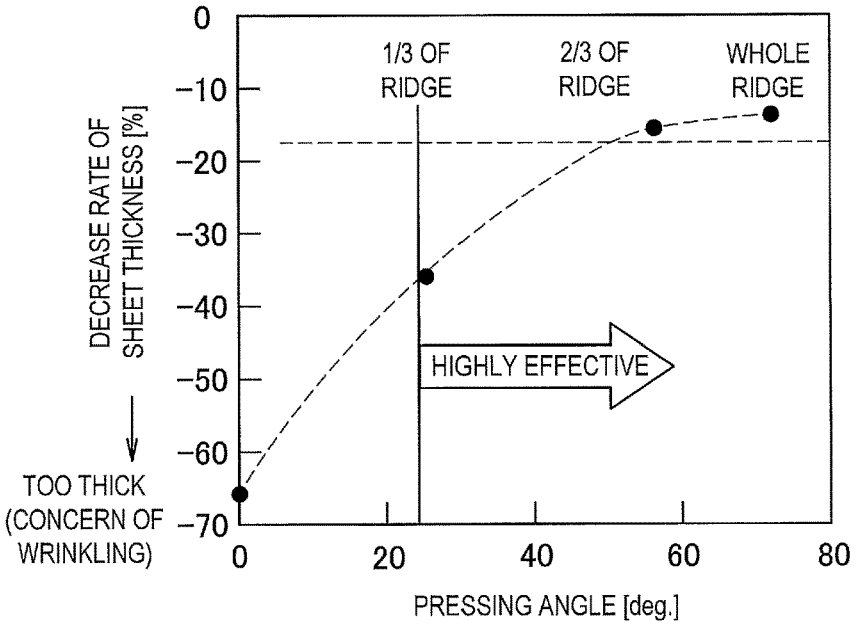

FIG. 6 is a characteristic diagram illustrating a relationship between an extent pressed by a second pad in a portion to be formed into a ridge and a minimum value of a decrease rate of sheet thickness near the base of a flange in an end of a ridge.

Figure 7:
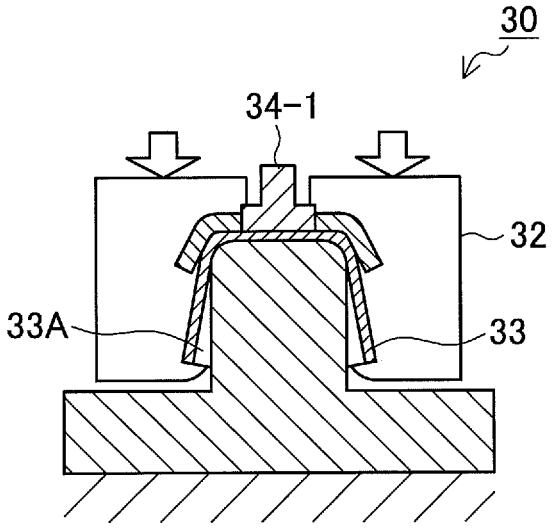

FIG. 7 is a cross-sectional view illustrating a state in which a die and punch press form a forming material.

Figure 8:
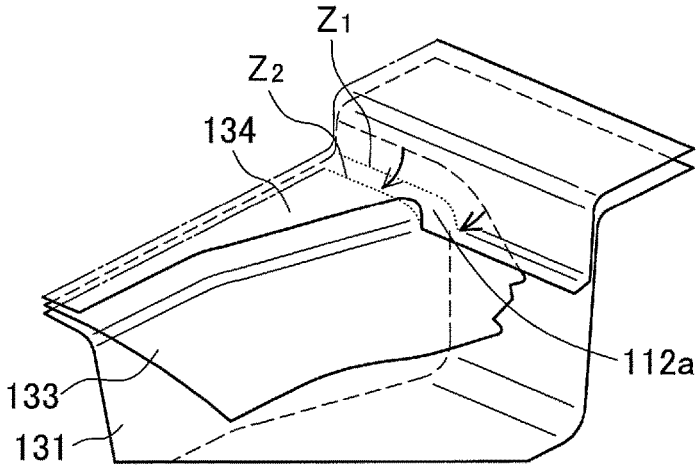
Figure 8:
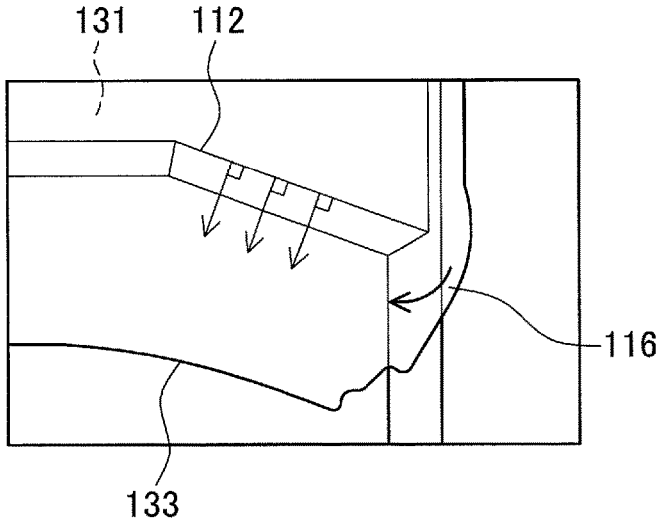

FIG. 8 (*a*) is a perspective view illustrating an example in which a pad is used to press a gutter bottom and portions to be formed into ridges simultaneously, and FIG. 8 (*b*) is a view for explaining a forming material when the pad is used to carry out press forming.

Figure 9:
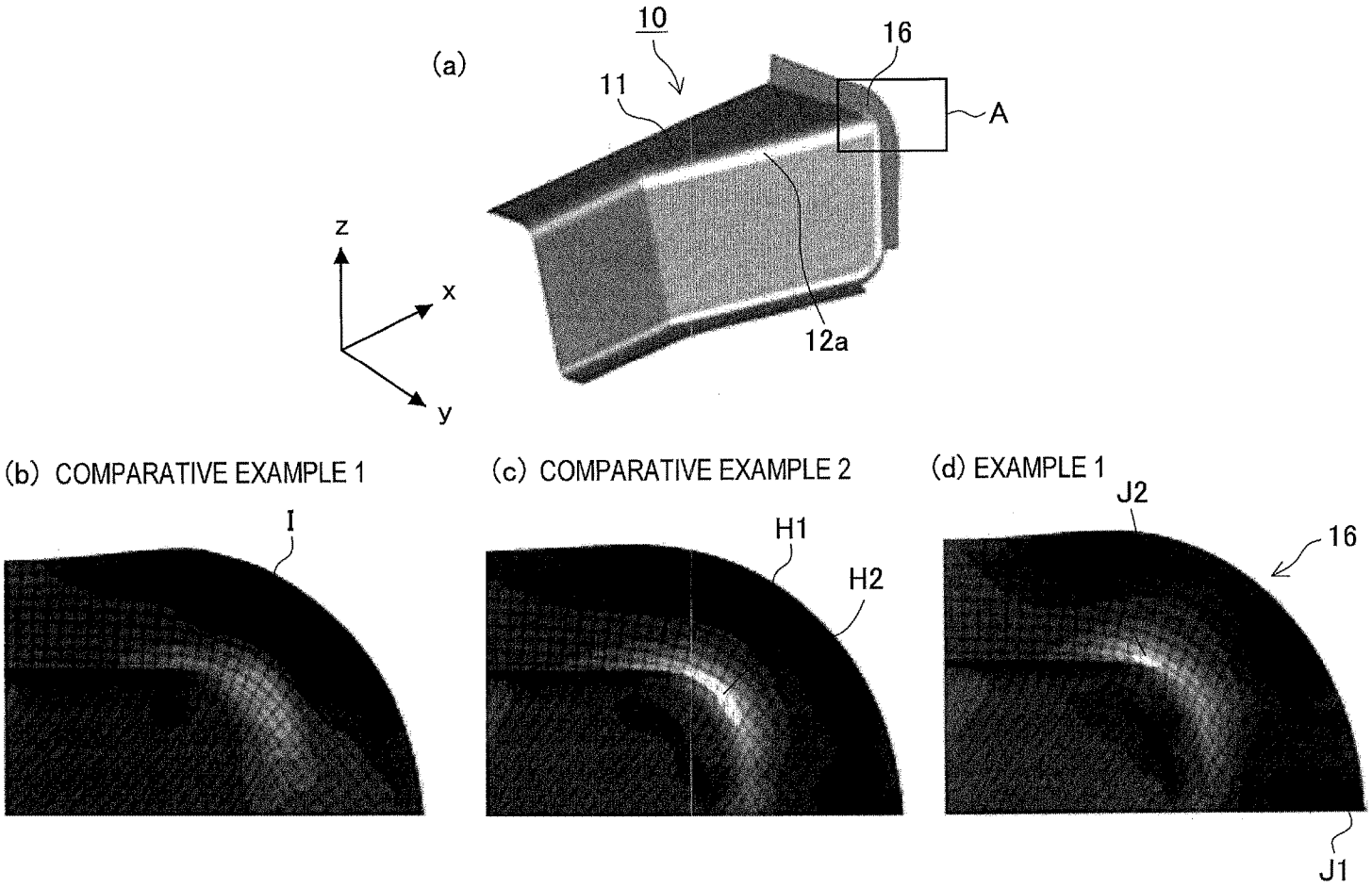

FIG. 9 (*a*) a schematic view illustrating a location on a press-formed product at which a decrease rate of sheet thickness is analyzed. FIG. 9 (*b*) shows analytical results for Comparative Example 1, and FIG. 9 (*c*) and FIG. 9 (*d*) show analytical results for Comparative Example 2 and Example 1, respectively.

Figure 10:
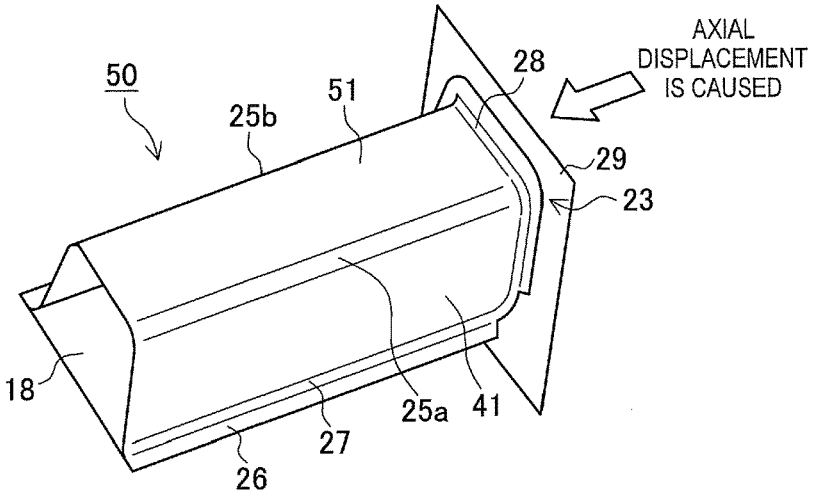
Figure 10:
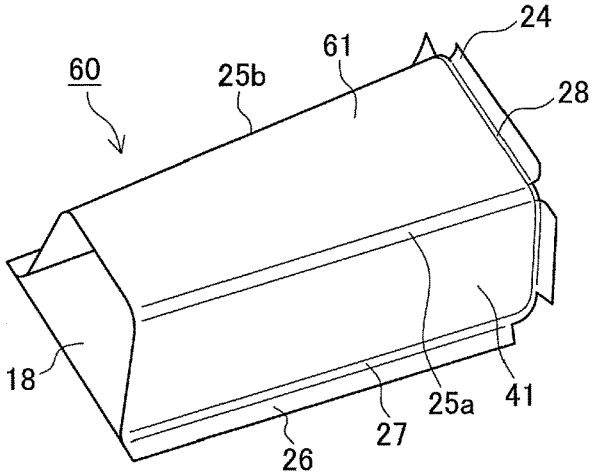
Figure 10:
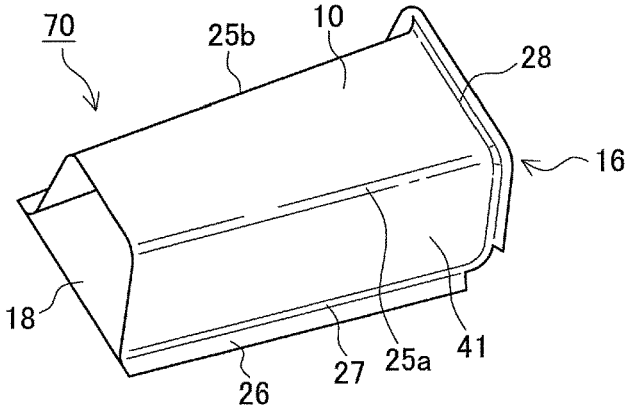

FIG. 10 (*a*) illustrates an analytical model according to Comparative Example 3, and FIG. 10 (*b*) and FIG. 10 (*c*) illustrate analytical models according to Comparative Example 4 and Example 2, respectively.

Figure 11:
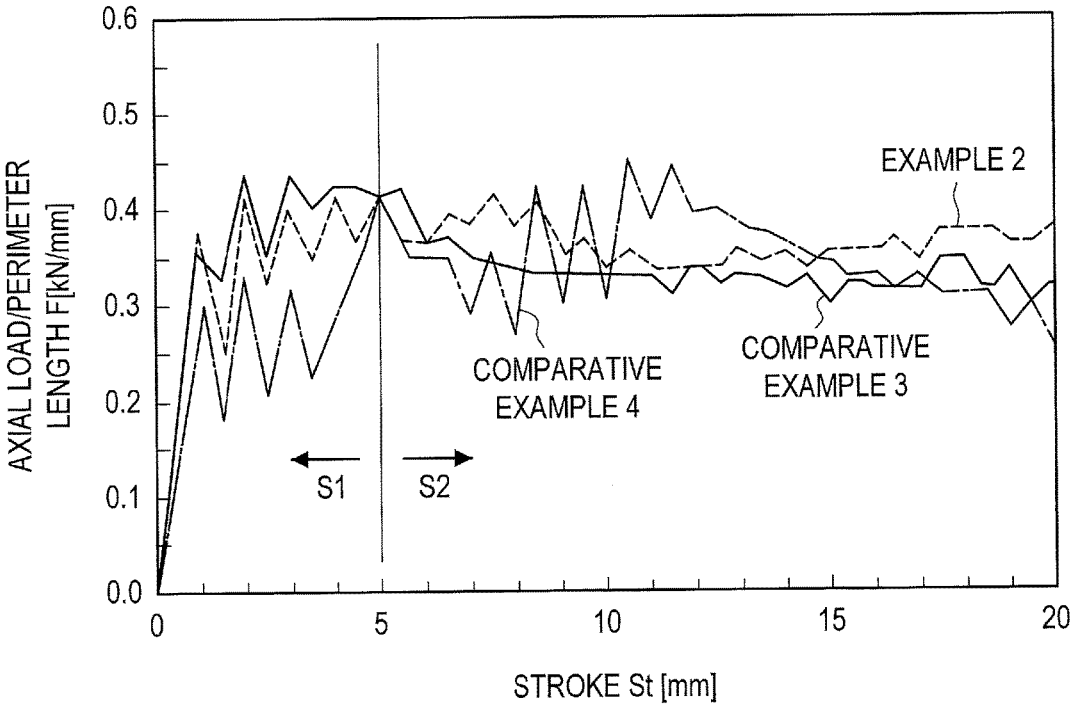

FIG. 11 is a graph representing analytical results on axial loads of analytical models.

Figure 12:
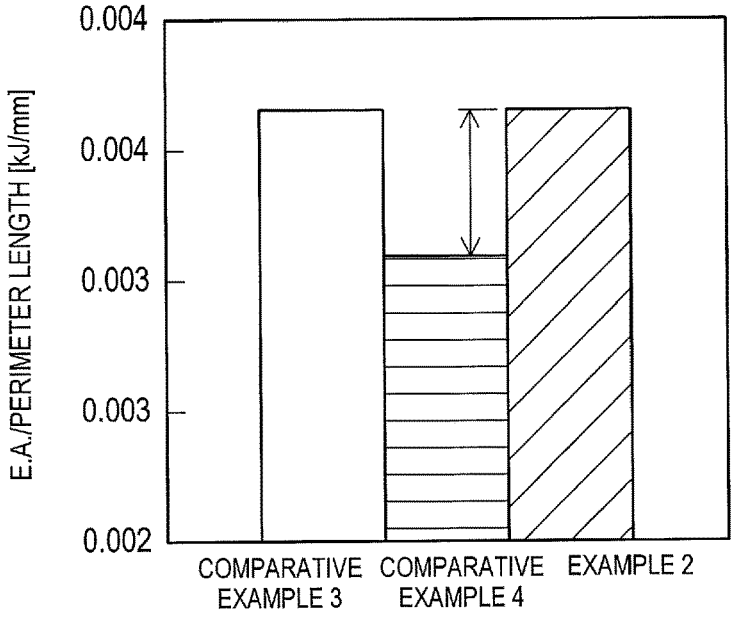
Figure 12:
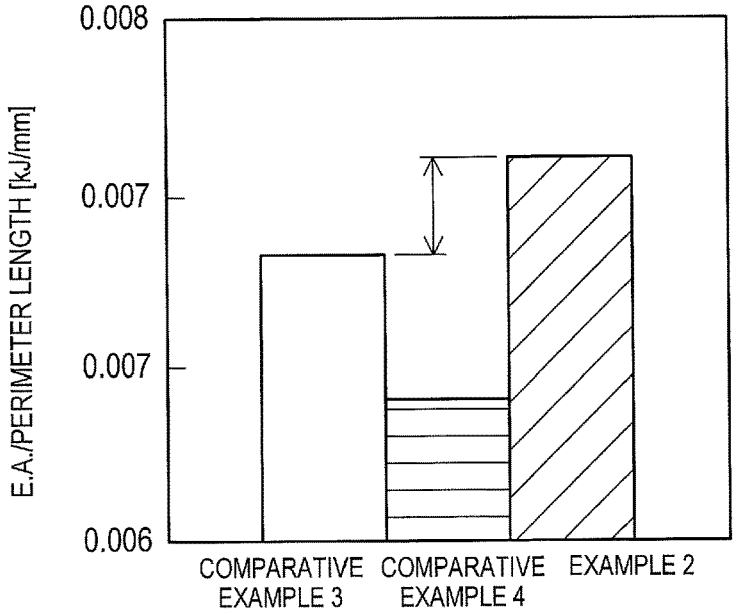

FIG. 12 (*a*) is a graph representing analytical results on an impact energy absorption amount of each analytical model at a crush stroke of 10 mm, and FIG. 12 (*b*) is a graph representing analytical results on an impact energy absorption amount of each analytical model at a crush stroke of 20 mm.

Figure 13:
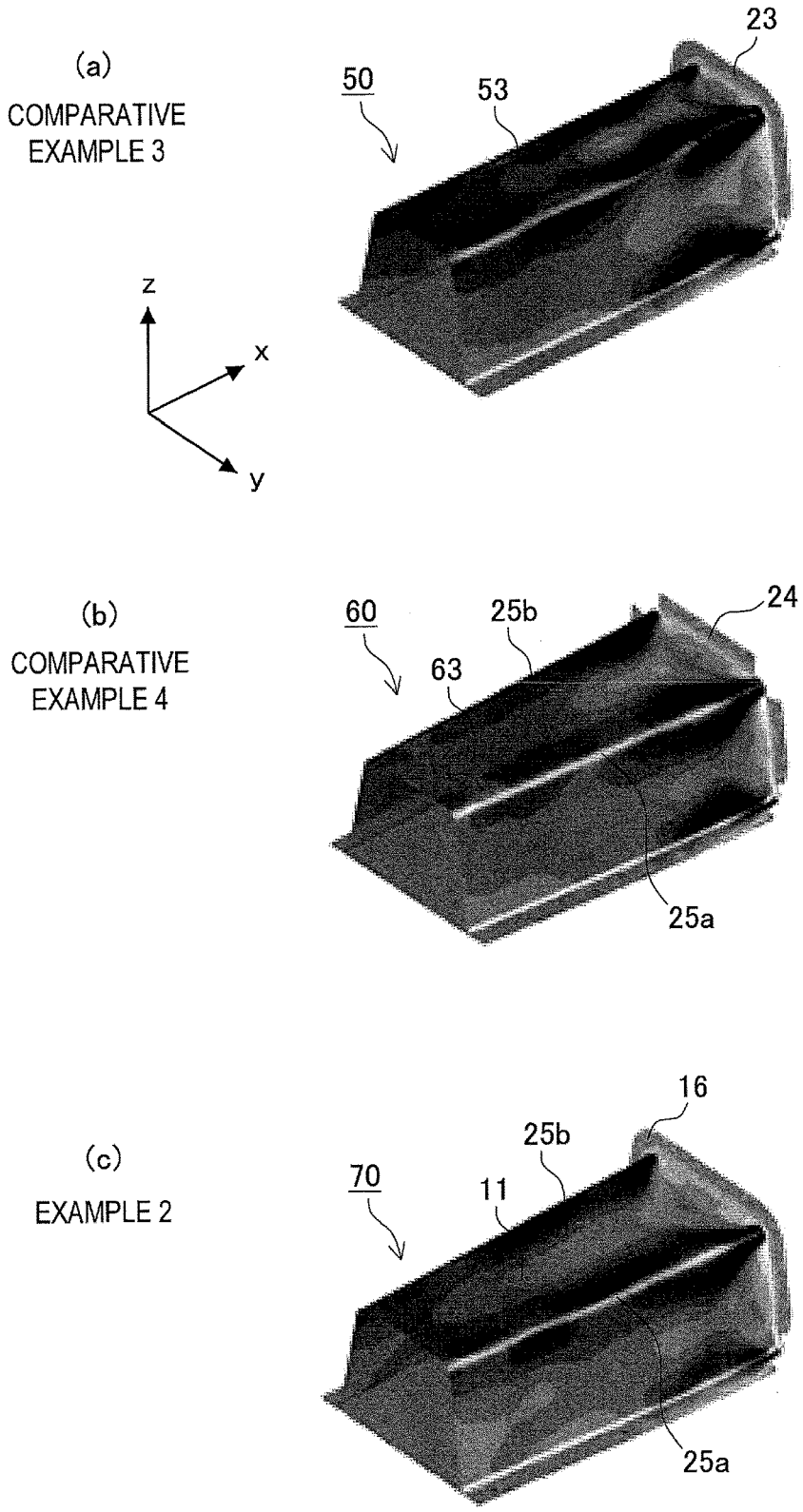

FIGS. 13 (*a*) to 13 (*c*) are contour graphs representing distribution of stress (MPa) in each analytical model along an X direction at a crush stroke of 5 mm.

Figure 14:
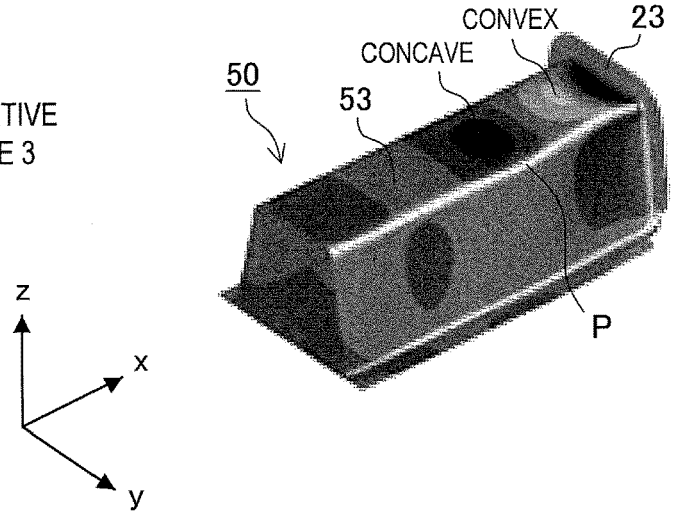
Figure 14:
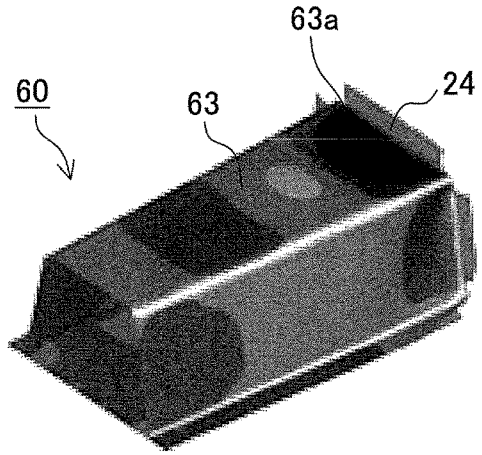
Figure 14:
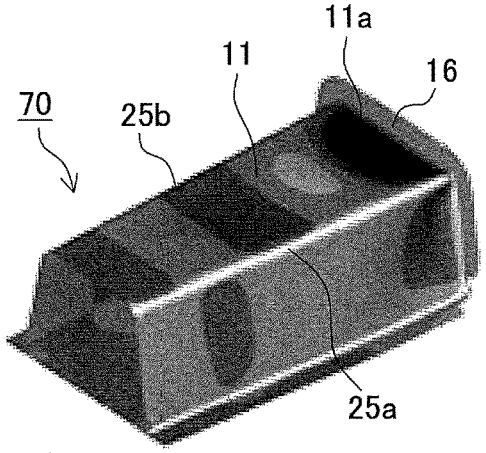

FIGS. 14 (*a*) to 14 (*c*) are contour graphs representing distribution of out-of-plane displacement in each analytical model along a Z direction at a crush stroke of 5 mm.

Figure 15:
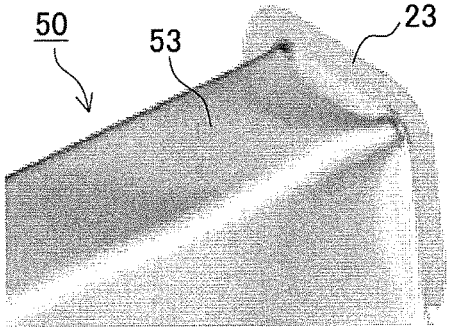
Figure 15:
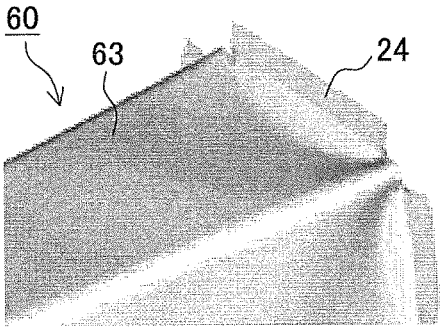
Figure 15:
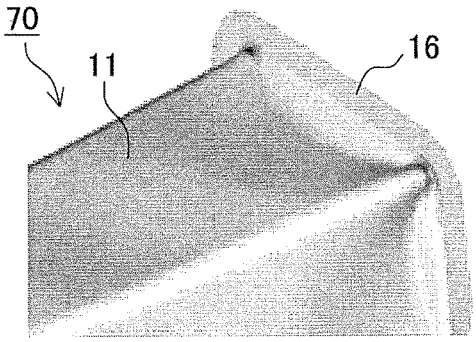

FIGS. 15 (*a*) to 15 (*c*) are contour graphs representing distribution of equivalent plastic strain in each analytical model at a crush stroke of 5 mm.

Figure 16:
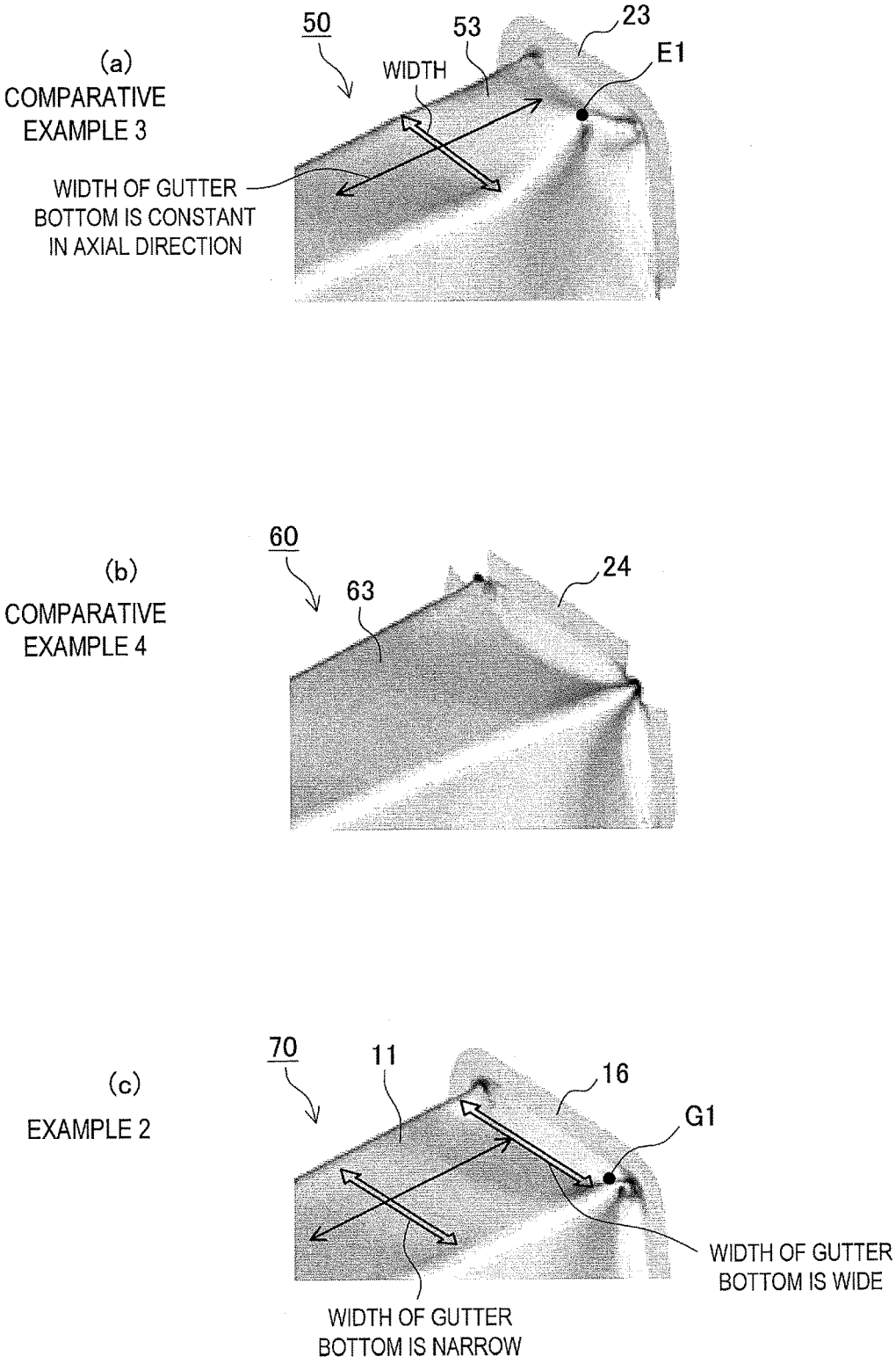

FIGS. 16 (*a*) to 16 (*c*) are contour graphs representing distribution of equivalent plastic strain in each analytical model at a crush stroke of 10 mm.

Figure 17:
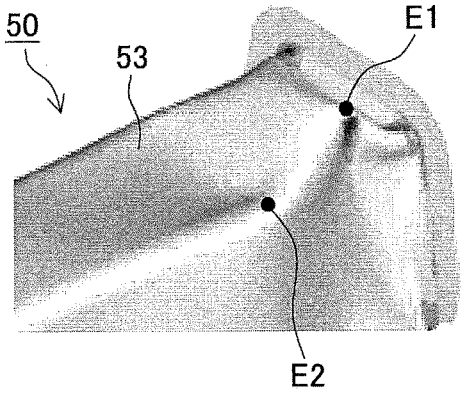
Figure 17:
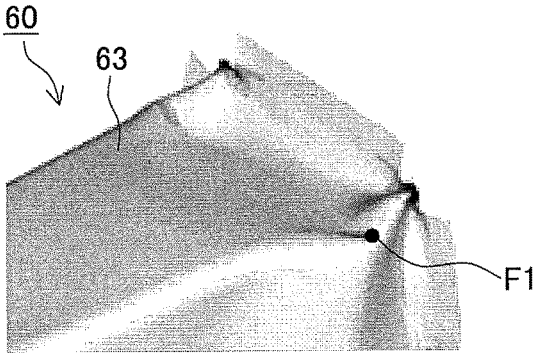
Figure 17:
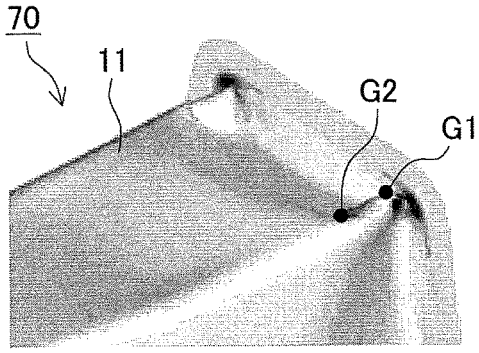

FIGS. 17 (*a*) to 17 (*c*) are contour graphs representing distribution of equivalent plastic strain in each analytical model at a crush stroke of 15 mm.

Figure 18:
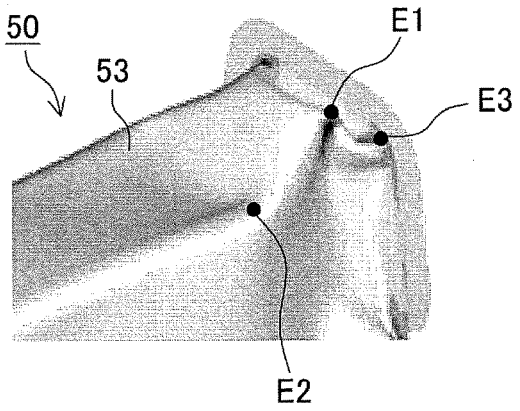
Figure 18:
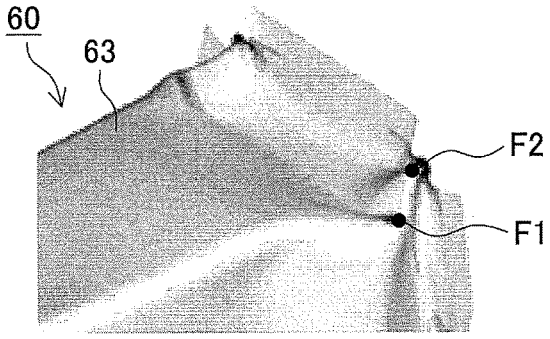
Figure 18:
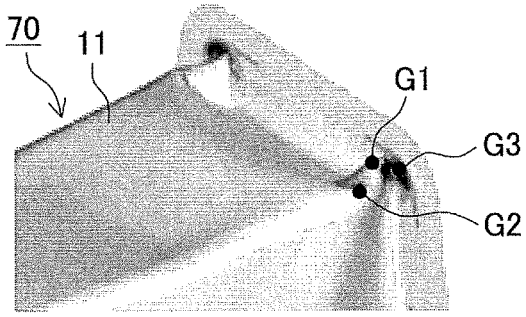

FIGS. 18 (*a*) to 18 (*c*) are contour graphs representing distribution of equivalent plastic strain in each analytical model at a crush stroke of 20 mm.

Figure 19:
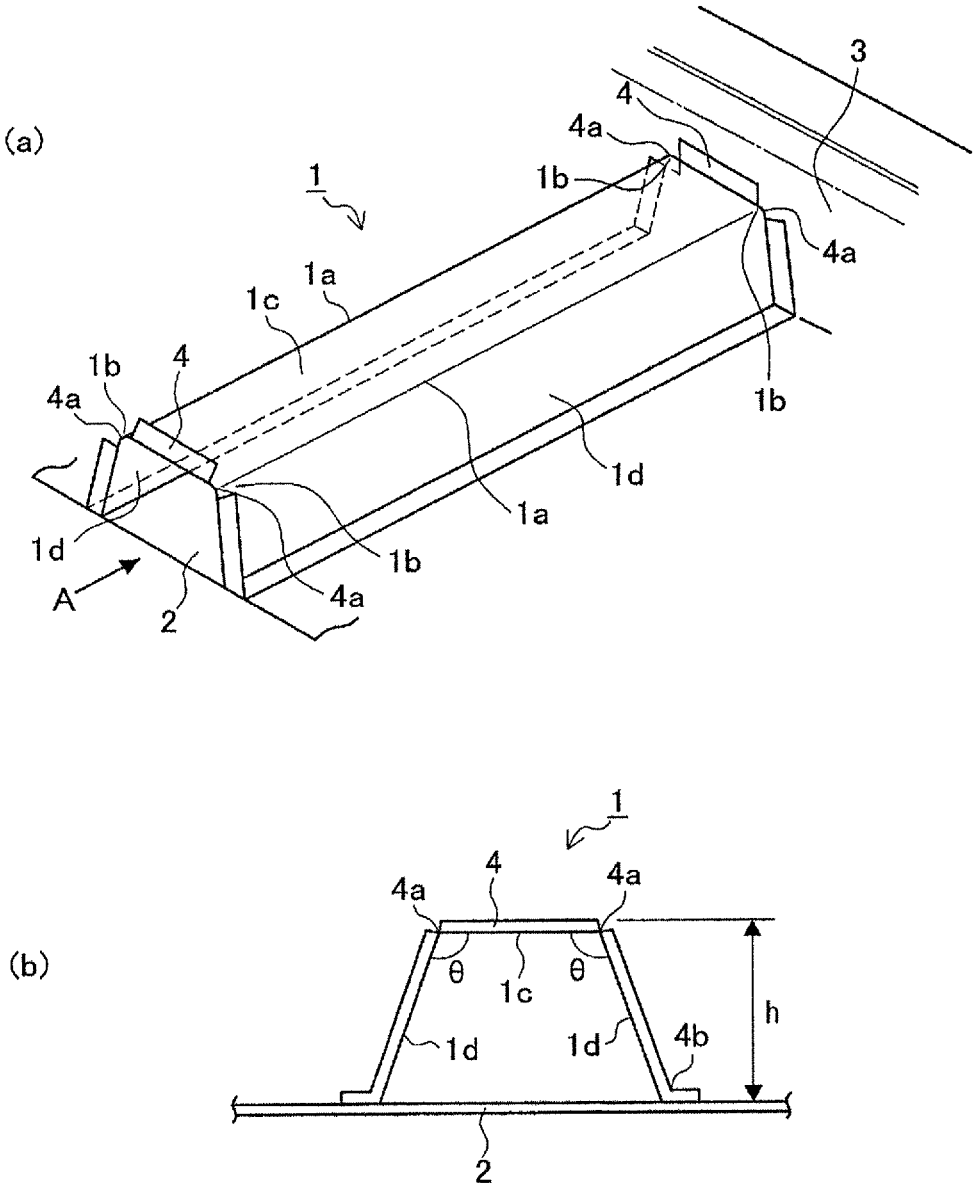
FIG. 19 PRIOR ART

FIG. 19 (*a*) is a perspective view illustrating a floor cross member that is a representative example of a member joined to other members with outward continuous flanges formed at both ends in the longitudinal direction. FIG. 19 (*b*) is a view on the arrow A in FIG. 19 (*a*).

MODE(S) FOR CARRYING OUT THE INVENTION

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

1. Press-Formed Product

A method for manufacturing a press-formed product and a press-forming apparatus according to an embodiment of the present invention are provided to manufacture a press-formed product having an outward continuous flange of desired shape. Accordingly, a press-formed product manufactured according to the present embodiment will be first explained. The explanation will be made using an exemplary press-formed product in which the width of a gutter bottom or the height of vertical walls gradually increases toward the end that has an outward continuous flange (such a shape of a press-formed product is hereinafter referred to as a "widening-toward-end shape").

Figure 1:
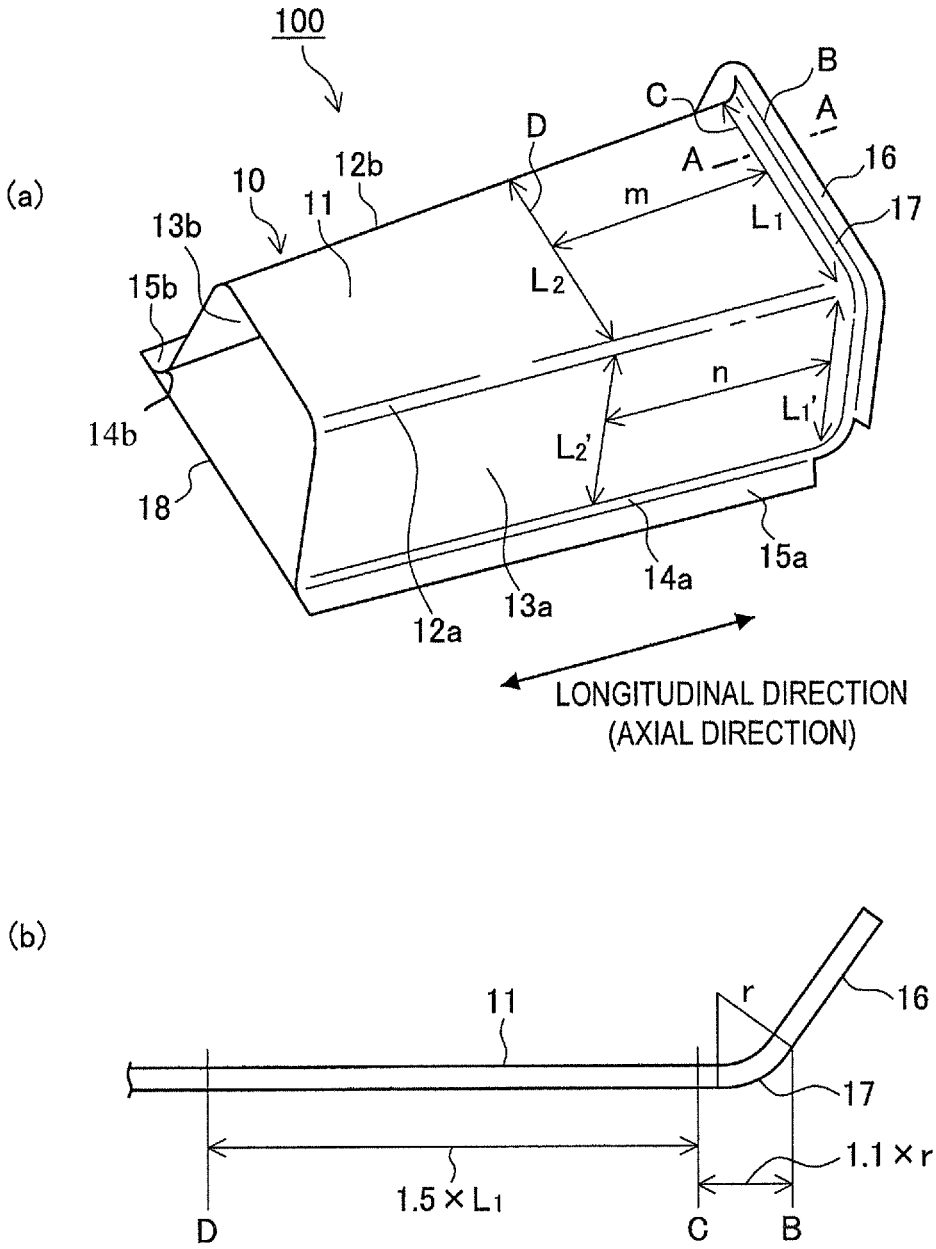
FIG. 1 (*a*) is a perspective view illustrating an example of a press-formed product manufactured according to the present embodiment, and FIG. 1 (*b*) is a cross-sectional view taken along A-A in FIG. 1 (*a*).

FIGS. 1 (*a*) and 1 (*b*) illustrate an example of a press-formed product 10 manufactured using the method for manufacturing the press-formed product and the press-forming apparatus according to the present embodiment. FIG. 1 (*a*) is a perspective view illustrating a structural member 100 including a press-formed product 10, and FIG. 1 (*b*) is a cross-sectional view taken along A-A in FIG. 1 (*a*).

The press-formed product 10 is a press-formed product that is formed extending in a predetermined direction (a direction designated by the arrow X in FIG. 1 (*a*), namely, an axial direction), and is made of a high-tensile steel sheet having a tensile strength of 390 MPa or more measured by tensile testing in accordance with JIS Z2241. The longitudinal direction of the press-formed product 10 illustrated in FIG. 1 (*a*) serves as the predetermined direction. The predetermined direction, however, is not limited to the longitudinal direction of the press-formed product 100.

The press-formed product 10 illustrated in FIG. 1 (*a*) can be used as a member constituting a structural member 100 of an automotive bodyshell. Examples of the structural member 100 include a floor cross member, a side sill, a front side member, and a floor tunnel brace. When the structural member 100 is used as a reinforcing member for an automotive body, such as the floor cross member, the side sill, the front side member, the floor tunnel or the like, a high-strength steel sheet having a tensile strength preferably of 590 MPa or more, and more preferably of 780 MPa or more, is used as a forming material.

Incidentally, as used herein, the term "structural member 100" may represent a press-formed product 10 (a first member) itself that excludes a second member 18, or a composite member in which the press-formed product 10 (the first member) is joined to the second member 18. For example, when the structural member 100 is used as a floor cross member, a floor panel corresponds to the second member 18, and the press-formed product 10 itself, which is joined to the floor panel, becomes the floor cross member serving as the structural member 100. In addition, when the structural member 100 is used as a side sill, the press-formed product 10 (the first member) is joined to a closing plate or a second member having a substantially gutter-shaped cross section, which is similar to the first member, to form a cylindrically-shaped composite member, and the cylindrically-shaped composite member serves as the structural member 100.

Moreover, when the structural member 100 is used as a front side member, the cylindrically-shaped composite member made of the press-formed product 10 (the first member) and the second member, which is generally the same as the case of the side sill, serves as the front side member. In the case of the front side member, however, the second member corresponds to, for example, a hood ridge panel, and the press-formed product 10 itself, which is joined to the hood ridge panel, is sometimes referred to as the front side member.

As illustrated in FIG. 1 (*a*), the press-formed product 10 has a gutter bottom 11, ridges 12*a*, 12*b*, vertical walls 13*a*, 13*b*, curved sections 14*a*, 14*b*, and flanges 15*a*, 15*b*. The two ridges 12*a*, 12*b* are formed continuing to both widthwise ends of the gutter bottom 11. The two vertical walls 13*a*, 13*b* are formed continuing to the two ridges 12*a*, 12*b*, respectively. The two curved sections 14*a*, 14*b* are formed continuing to the two vertical walls 13*a*, 13*b*, respectively. The two flanges 15*a*, 15*b* are formed continuing to the two curved sections 14*a*, 14*b*, respectively.

In addition, the two flanges 15*a*, 15*b* are joined to a second member 18 such as, for example, a closing plate or a formed panel that constitutes a bodyshell (for example, floor panel). In this way, the press-formed product 10 serving as the first member and the second member 18 form a closed cross-sectional shape. It should be noted that the curved section 14*a*, 14*b* continuing to the vertical walls 13*a*, 13*b* and the flanges 15*a*, 15*b* continuing to the curved section 14*a*, 14*b* may be omitted from the press-formed product manufactured using the method for manufacturing a press-formed product and the press-forming apparatus according to the present embodiment.

The press-formed product 10 has an outward continuous flange 16 in a longitudinal end. In the press-formed product 10 illustrated in FIG. 1 (*a*) by way of example, the outward continuous flange 16 is continuously formed, in the longitudinal end, along the peripheral direction of the cross section of the gutter bottom 11, the ridges 12*a*, 12*b*, and the vertical walls 13*a*, 13*b*. It is sufficient, however, that the press-formed product 10 according to the present embodiment has the outward continuous flange 16 formed, in the longitudinal end, at least along the gutter bottom 11 and the ridges 12*a*, 12*b*.

The outward continuous flange 16 is formed in the longitudinal end of the press-formed product 10 via a curved rising surface 17 having a curvature radius of r (mm) (refer to FIG. 1 (*b*)). In addition, the press-formed product 10 has a widening-toward-end shape in which the width of the gutter bottom 11 or the height of the vertical walls 13*a*, 13*b* gradually increases along the longitudinal direction toward the end having the outward continuous flange 16. The press-formed product 10 preferably satisfies the relations expressed in the following formula (1):

$$L_2 \times 1.1 < L_1 \quad (1)$$

In the above formula (1), reference signs $L_1$ and $L_2$ represent sizes of at least either a width (mm) of the gutter bottom 11 or a height (mm) of the vertical walls 13*a*, 13*b* at positions along the longitudinal direction as defined below. The width of the gutter bottom 11 means a length of the gutter bottom 11 in the direction perpendicular to the center line m along the longitudinal direction when viewing the plane constituting the gutter bottom 11 as a planer view. The height of the vertical walls 13*a*, 13*b* means lengths of the vertical walls 13*a*, 13*b* in the direction perpendicular to the center line n along the longitudinal direction when viewing the planes constituting the vertical walls 13*a*, 13*b* as planer views.

The reference sign $L_1$ means the width of the gutter bottom 11 or the height of the vertical walls 13*a*, 13*b* at the position C that is 1.1×r (mm) away, along the longitudinal direction toward the side opposite to the outward continuous flange 16, from the end position B that is located on the side of the outward continuous flange 16, among two ends of the curved line that the curved rising surface 17 makes (refer to FIG. 1 (*b*)). The reference sign $L_2$ means the width of the gutter bottom 11 or the height of the vertical walls 13*a*, 13*b* at the position D that is $1.1 \times r + 1.5 \times L_1$ (mm) away, along the longitudinal direction toward the side opposite to the outward continuous flange 16, from the end position B that is located on the side of the outward continuous flange 16, among two ends of the curved line that the curved rising surface 17 makes (refer to FIG. 1 (*b*)).

Regarding the flange width of the outward continuous flange 16, even if the flange width is 25 mm or more, a press-formed product 10 having an outward continuous flange 16 of desired shape can be obtained according to the method for manufacturing a press-formed product according to the present embodiment. From a view point of making spot welding easier, for example, it is preferable that the flange width is 13 mm or more. It should be noted that the outward continuous flange 16 of the press-formed product 10 according to the present embodiment does not have notches in the ends of the ridges 12*a*, 12*b*. Accordingly, the rigidity and collision-safety capability of the press-formed product 10 can be maintained even if the flange width of the outward continuous flange 16 is 13 mm or less. From a view point of maintaining the collision-safety capability, the flange rising angle, which is an angle between the outward continuous flange 16 and the gutter bottom 11 or the vertical wall 13*a* or 13*b*, is preferably 60° or more.

The structural member 100 including the press-formed product 10 has the outward continuous flange 16 formed from the gutter bottom 11 to the vertical walls 13*a*, 13*b* in the longitudinal end. Thereby, stress concentration in the ridges 12*a*, 12*b* in the end of the press-formed product 10 can be suppressed at an initial stage of crushing in the axial direction of the structural member 100 (for example, at a crush stroke of 5 mm or less). Consequently, the strain produced in the ends of the ridges 12*a*, 12*b* is reduced, and the load transfer property of the structural member 100 along the axial direction, when an impact load is applied, is made to improve.

Moreover, the structural member 100 including the press-formed product 10 has a widening-toward-end shape in which at least one of the width of the gutter bottom 11 and the height of the vertical walls 13*a*, 13*b* gradually increases toward the end having the outward continuous flange 16. Due to this, buckling pitch in the axial crushing becomes smaller, and the number of buckling portions increases at a later stage of crushing in the axial direction of the structural member 100 (for example, at a crush stroke of 5 mm or more). In particular, the amount of impact energy absorption increases at a crush stroke of more than 70 mm, which results in a further increase in the load transfer property of the structural member 100 in the axial direction when an impact load is applied.

In short, the press-formed product 10, which has the widening-toward-end shape and the outward continuous flange 16 in the end, exhibits excellent load transfer property in the initial and the later stage of the axial crushing. Due to constraints in press forming, however, the press-formed product 10 having such a shape is vulnerable to cracking generation in the edge of the flange formed continuing to teach end of the ridges 12*a*, 12*b* and wrinkling generation near the base of the flange in the vicinity of the ends of the ridges 12*a*, 12*b* in the outward continuous flange 16. Therefore, the method for manufacturing a press-formed product and the press-forming apparatus according to the present embodiment are particularly suitable for forming the press-formed product 10 having the widening-toward-end shape and the outward continuous flange 16.

There is no particular limitation to a method for joining the press-formed product 10 serving as the first member, to the second member 18 via the flanges 15*a*, 15*b* as far as the joining strength is guaranteed. It is practical and also typical to use a joining method using spot welding to weld a plurality of spots along the longitudinal direction of the structural member 100. However, any other joining method such as, for example, laser welding may be used depending on the flange width and other requirements.

In addition, it is sufficient that the outward continuous flange 16 is formed along a region at least from the gutter bottom 11 to the ridges 12*a*, 12*b* in a longitudinal end of the press-formed product 10. It is preferable that the outward continuous flange 16 is formed along a region from the gutter bottom 11 to the vertical walls 13*a*, 13*b* in a longitudinal end of the press-formed product 10. This outward continuous flange 16 makes it easier to disperse the load applied to the ridges 12*a*, 12*b*, and then can reduce the stress concentration in the ridges 12*a*, 12*b*.

The flange width of the outward continuous flange 16 may not be constant. For example, the flange width in the region corresponding to each ridge 12*a*, 12*b* in the outward continuous flange 16 may be made smaller. The smaller flange width can be advantageous in reducing cracking in the outward flange formed in the end of each ridge 12*a*, 12*b* and wrinkling in the vicinity of the end of the ridges 12*a*, 12*b*. However, the method for manufacturing a press-formed product and the press-forming apparatus according to the present embodiment can also reduce the cracking and wrinkling even though the flange width is relatively large.

2. Method for Manufacturing Press-Formed Product and Press-Forming Apparatus

The method for manufacturing a press-formed product and the press-forming apparatus according to the present embodiment will now be described. As described above, the method for manufacturing a press-formed product and the press-forming apparatus according to the present embodiment are a method and an apparatus to be used for manufacturing the press-formed product 10 having the outward continuous flange 16 in at least one end in the predetermined direction as illustrated in FIG. 1 (*a*) by way of example. The method for manufacturing the press-formed product will now be outlined hereafter, and then a press-forming apparatus 30 and the method for manufacturing the press-formed product according to the present embodiment will be described in detail.

(2-1. Outline of Manufacturing Method)

The method for manufacturing a press-formed product according to the present embodiment is first outlined. The method for manufacturing the press-formed product according to the present embodiment includes a first step carried out by using a first press-forming apparatus and a second step carried out by using a second press-forming apparatus.

(2-1-1. Outline of First Step)

The first step is carried out by using the first press-forming apparatus. The first press-forming apparatus corresponds to a press-forming apparatus according to the present embodiment, which will be described later. In the first step, a first pad presses at least a part of the portion to be formed into the gutter bottom in a forming material. By doing so, the end of the forming material, which continues to the portion to be formed into the gutter bottom, is raised in the direction opposite to the pressing direction of the first pad. The first pad subsequently presses the forming material against a first punch so that at least a part of the portion to be formed into the gutter bottom is restrained by the first pad and the first punch.

After the portion to be formed into the gutter bottom in the forming material is restrained by the first pad, a second pad, which is different from the first pad, presses at least a part of a longitudinal end of the portion to be formed into ridges in the forming material. By doing so, the end of the forming material, which continues to the portion to be formed into the ridges, is raised in the direction opposite to the pressing direction of the second pad. While the second pad subsequently bends the portion to be formed into the ridges in the forming material to the pressing direction of the second pad, the second pad and the first punch restrain at least a part of the portion to be formed into the ridges.

Subsequently, a first die is moved closer to the first punch to press form the forming material while the forming material is restrained by the first and second pads and the first punch. The above-described first step forms an intermediate product that has the outward continuous flange in a longitudinal end with cracking in the flange and wrinkling in the vicinity of the ends of the ridges being reduced.

(2-1-2. Outline of Second Step)

The second step is carried out by using the second press-forming apparatus, which is different from the first press-forming apparatus. The first step uses the first pad that restrains the portion to be formed into the gutter bottom and the second pad that restrains the portion to be formed into the ridges. Accordingly, there remains a part of the press forming material that is not completely pressed by the first die and the first punch. Thus, the second step forms the press-formed product by press forming the intermediate product using a second punch and a second die.

The second press-forming apparatus may be a type of apparatus capable of press forming the portion that the first press-forming apparatus does not form. In particular, the second press-forming apparatus may be a type of apparatus capable of press forming the region that has not been restrained by the first pad or the second pad in the portions to be formed into the gutter bottom, the ridges, and the vertical walls. Further, the second press-forming apparatus may be a type of apparatus that press forms the part of the outward continuous flange that the first press-forming apparatus does not form. The second press-forming apparatus can be constituted by a known press-forming apparatus having a die and punch.

(2-2. Manufacturing Apparatus)

Figure 2:
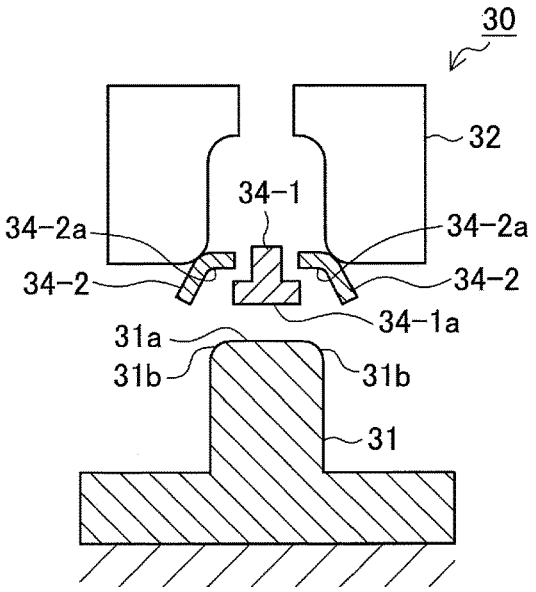
FIG. 2 (*a*) is a cross-sectional view illustrating an example of the press-forming apparatus according to the present embodiment, and FIG. 2 (*b*) is a perspective view illustrating a press-forming apparatus according to the present embodiment.
Figure 2:
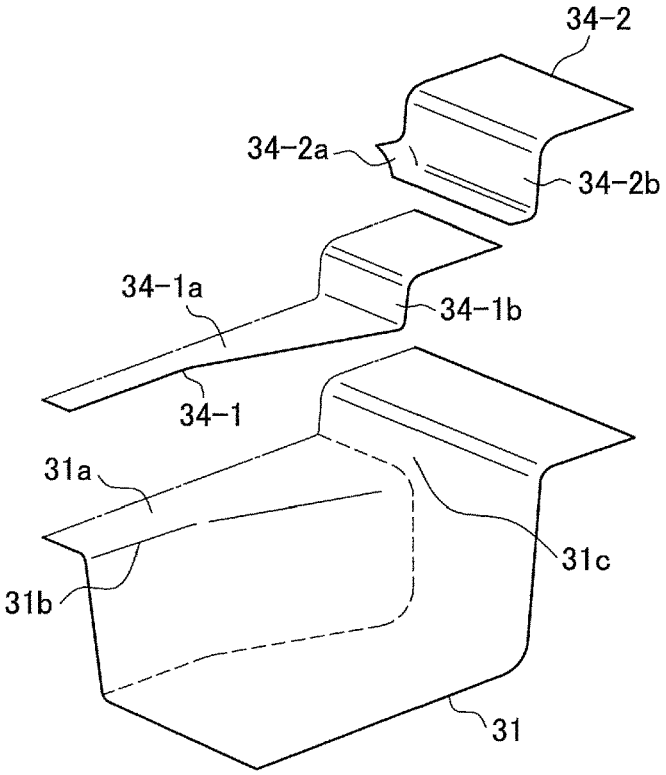

Now, the press-forming apparatus according to the present embodiment will be described below. As described in the foregoing, the press-forming apparatus according to the present embodiment is the first press-forming apparatus to be used to form the intermediate product in the first step of the method for manufacturing a press-formed product. FIG. 2 (*a*) and FIG. 2 (*b*) illustrate a schematic structure for describing the exemplary first press-forming apparatus 30. FIG. 2 (*a*) is a sectional view outlining a part of the first press-forming apparatus 30 that forms the end region of the press-formed product, and FIG. 2 (*b*) is a perspective view outlining the first press-forming apparatus 30. FIG. 2 (*b*) illustrates only half portions of a first punch 31 and a first pad 34-1, which are divided in half at the center line along the longitudinal direction of the intermediate product to be formed.

The first press-forming apparatus 30 has a first punch 31, a first die 32, and a first pad 34-1 and a second pad 34-2 both of which face the first punch 31. The first press-forming apparatus 30 is fundamentally configured to press form a forming material by moving the first die 32 closer to the first punch 31 with the forming material being restrained by the first and second pads 34-1, 34-2 and the first punch 31.

The first punch 31 has punch surfaces on the sides facing the first die 32, the first pad 34-1, and the second pad 34-2. The first punch 31 has an upper surface 31*a*, shoulders 31*b* for forming the ridges of the intermediate product, and a flange-forming part 31*c*.

The first pad 34-1 has a restraining surface 34-1*a* and a flange-forming part 34-1*b*. The restraining surface 34-1*a* of the first pad 34-1, which is disposed facing the upper surface 31*a* of the punch 31, presses the forming material against the upper surface 31*a* of the punch 31 and restrains the forming material. The part of the forming material that is restrained by the restraining surface 34-1*a* and the upper surface 31*a* is the portion to be formed into the gutter bottom. The restrained part of the forming material may be the whole portion or a part of the portion to be formed into the gutter bottom. However, at least the vicinity of the end on the side having the outward continuous flange in the portion to be formed into the gutter bottom is made to be restrained. The flange-forming part 34-1*b* of the first pad 34-1 presses the forming material against the flange-forming part 31*c* of the punch 31. By doing so, the flange to be formed in the end of the gutter bottom in the forming material is bent upward.

The second pad 34-2 has restraining surfaces 34-2*a* and a flange-forming part 34-2*b*. The second pad 34-2 is disposed in the way that it does not interfere with the first pad 34-1 in press forming. Each restraining surface 34-2*a* of the second pad 34-2, which is disposed facing the shoulder 31*b* of the punch 31, presses and then restrains the forming material against the shoulder 31*b* of the punch 31. The part of the forming material restrained by the restraining surface 34-2*a* and the shoulder 31*b* is at least a part of the end region of the portion to be formed into each ridge. The flange-forming part 34-2*b* of the second pad 34-2 presses the forming material against the flange-forming part 31*c* of the punch 31. In this way, the flange to be formed in the end of each ridge in the forming material is bent upward.

The second pad 34-2 restrains the portions to be formed into ridges in the vicinity of the outward continuous flange while the portion to be formed into the gutter bottom is restrained by the first pad 34-1. Accordingly, the shapes of the ridges in the vicinity of the outward continuous flange is formed by projecting outward the material approximately in the region pressed by the second pad 34-2. This restrains the movement of the material surrounding the region contacted by the second pad 34-2, and thus reduces stretch or shrinkage deformation of the surrounding material, which otherwise causes cracking and wrinkling Consequently, the generation of cracking of stretched flange in the region corresponding to the ridge in the outward continuous flange, and the generation of wrinkling near the base of the flange at the ridges in the vicinity of the ends of the ridges can be reduced.

In addition, the second pad 34-2 is aimed at projecting outward the material in the vicinity of the outward continuous flange and forming the ridges so as to reduce the movement of the surrounding material. For this purpose, it is preferable that the second pad 34-2 restrains the whole portions to be formed into the ridges in the vicinity of the portion to be formed into the outward continuous flange, starting from the border between the portion to be formed into the gutter bottom and the portions to be formed into the ridges.

More specifically, it is preferable that the region of the forming material that is restrained by the restraining surface 34-2*a* of the second pad 34-2 includes the border between the portion to be formed into the gutter bottom and the portion to be formed into each ridge. It is particularly preferable that the second pad 34-2 restrains the region of at least ⅓ of the perimeter length of the cross section starting from the above-described border in the portions to be formed into the ridges 12*a*, 12*b*. The second pad 34-2 presses the above-mentioned region, while restraining the movement of the surrounding steel sheet material and projecting outward the steel sheet material in the region pressed by the restraining surface 34-2*a* of the second pad 34-2, so that a part of each ridge 12*a*, 12*b* can be formed. It should be noted that the second pad 34-2 may be configured to press the ridge and a part of the vertical wall, in other word, a region of 20 mm or less in length of the vertical wall that continues to the ridge, for example.

Other properties of the first pad 34-1 and the second pad 34-2, such as dimensions and materials, can be the same as those of pads known in the art.

The first die 32 is moved closer to the first punch 31 to press form the forming material with the forming material being restrained by the first pad 34-1 and the second pad 34-2. The first die 32 is disposed in the way that it does not interfere with the first pad 34-1 and the second pad 34-2 during press forming. The first pad 34-1, the second pad 34-2, and the first die 32 are preferably arranged with a minimum spacing with respect to the pressing direction.

The first press-forming apparatus 30 according to the present embodiment is configured to have the first pad 34-1, the second pad 34-2, and the first die 32 press the forming material in this order. In other words, the second pad 34-2 restrains the end region in the portions to be formed into the ridges after at least a part of the portion to be formed into the gutter bottom is restrained by the first pad 34-1. The first die 32 subsequently press forms the forming material with the forming material being restrained by the first pad 34-1 and the second pad 34-2.

This configuration has been achieved in the present embodiment by suspending the first pad 34-1 and the second pad 34-2 from the die 32 with coil springs. More specifically, the restraining surface 34-1*a* of the first pad 34-1, the restraining surfaces 34-2*a* of the second pad 34-2, and the press surface of the first die 32 are arranged in this order from the side of the first punch 31 in the state before press forming. By moving the first die 32 toward the first punch 31, the first die 32 press forms the forming material after the first pad 34-1 and the second pad 34-2 consecutively contact with, and then restrain, the forming material in this order. Subsequently, the first die 32 press forms the forming material.

It should be noted that one or all of the first pad 34-1, the second pad 34-2, and the first die 32 may be configured to be able to move independently toward the first punch 31. In this case, the order of contacting with the forming material is controlled by controlling each movement of the first pad 34-1, the second pad 34-2, and the first die 32.

Incidentally, due to the presence of the first pad 34-1 or the second pad 34-2, there are regions in which the first die 32 does not press the forming material against the first punch 31. For example, the first die 32 does not press form vertical walls and the flanges that are overlapped by the second pad 34-2 in the pressing direction. These regions are press formed by the second press-forming apparatus in the second step. The second press-forming apparatus can be configured using a press-forming apparatus known in the art, and further description thereon is omitted.

(2-3. Manufacturing Method)

Now, the method for manufacturing a press-formed product according to the present embodiment will be described specifically. The method for manufacturing a press-formed product according to the present embodiment is an exemplary method illustrated by way of example in FIG. 1 (*a*) for manufacturing the press-formed product 10 having the widening-toward-end shape and the outward continuous flange 16.

(2-3-1. First Step)

FIGS. 3 to 7 are schematic views conceptually illustrating the first step carried out by using the first press-forming apparatus 30 as described above. FIGS. 3 (*a*) and 3 (*b*) are a cross-sectional view and a perspective view, schematically illustrating a state in which a forming material 33 is restrained by the first pad 34-1. FIGS. 4 (*a*) and 4 (*b*) are a cross-sectional view and a perspective view, schematically illustrating a state in which the forming material 33 is restrained by the second pad 34-2. FIG. 7 is a cross-sectional view schematically illustrating a state in which the forming material 33 is press formed by the first die 32.

It should be noted that FIGS. 3 to 7 illustrate the first step in manufacturing the press-formed product 10 having a widening-toward-end shape. In addition, FIG. 3 (*a*), FIG. 4 (*a*), and FIG. 7 illustrate a state in which the first step forms an end region in the longitudinal direction in the forming material 33, in which the outward continuous flange 16 is formed. FIGS. 3 (*b*) and 4 (*b*) illustrate only a half portion of the first punch 31, the first pad 34-1, and the forming material 33, which are divided in half at the center line along the longitudinal direction of an intermediate product to be formed. Moreover, a manufacturing method as described below uses the first press-forming apparatus 30 in which the first pad 34-1 and the second pad 34-2 are suspended from the first die 32.

In the first step as illustrated in FIGS. 3 (*a*) and 3 (*b*), as the first die 32 moves toward the first punch 31, the first pad 34-1 restrains the portion to be formed into the gutter bottom 11 in the forming material 33. At this time, as illustrated in FIG. 3 (*b*), the restraining surface 34-1*a* of the first pad 34-1 restrains at least a part of the portion to be formed into the gutter bottom 11 in the forming material 33. At the same time, a longitudinal end of the forming material 33 is raised in the direction opposite to the pressing direction, and then restrained by the flange-forming part 34-1*b* of the first pad 34-1 and the flange-forming part 31*c* of the first punch 31.

Subsequently, as the first die 32 moves further toward the first punch 31, the second pad 34-2 restrains the portion to be formed into each ridge 12*a*, 12*b* in the forming material 33, as illustrated in FIGS. 4 (*a*) and 4 (*b*). At this time, the restrained region in the forming material 33 is a region in the vicinity of the end of the portion to be formed into each ridge 12*a*, 12*b*. In other words, the restraining surfaces 34-2*a* of the second pad 34-2 restrain the end of the portions to be formed into the ridges 12*a*, 12*b* in the forming material 33, as illustrated in FIG. 4 (*b*). At the same time, the portion to be formed into the flange, which continues to the portion to be formed into each ridge 12*a*, 12*b*, is further raised in the direction opposite to the pressing direction, and then restrained by the flange-forming part 34-2*b* of the second pad 34-2 and the flange-forming part 31*c* of the first punch 31.

It is preferable at this time that the second pad 34-2 presses the region of at least ⅓ of the perimeter length of the cross section starting from the aforementioned border in the portion to be formed into each ridge 12*a*, 12*b*. The second pad 34-2 presses this region, while restraining the movement of the surrounding steel sheet material and projecting outward the steel sheet material in the region pressed by the restraining surface 34-2*a* of the second pad 34-2, so that a part of each ridge 12*a*, 12*b* can be formed.

FIG. 5 is a characteristic diagram illustrating a relationship between an extent pressed by the second pad 34-2 in the portion to be formed into the ridge and a minimum decrease rate of sheet thickness in the edge of the flange portion that continues to the ridge 12*a* or 12*b* in the outward continuous flange 16 to be formed. In FIG. 5, the pressed extent is represented by a pressing angle that means a central angle of the extent that the second pad 34-2 restrains, where the border between the portion to be formed into each ridge and the portion to be formed into the gutter bottom is set to 0°. The pressing angle of 0° means a state in which the portion to be formed into the ridge is not restrained.

As shown in FIG. 5, when the portion to be formed into the ridge is not restrained, a minimum decrease rate of sheet thickness in the edge of the flange is approximately 36%, which indicates a high possibility of generating cracking of stretched flange. In contrast, when restraining with a pressing angle of 23° or more, in other words, restraining the ridge region of at least ⅓ of the perimeter length of the cross section starting from the border, a minimum decrease rate of sheet thickness in the edge of the flange is suppressed to less than 25%. Accordingly, this shows that cracking in the edge of the flange is reduced.

FIG. 6 is also a characteristic diagram illustrating a relationship between an extent pressed by the second pad 34-2 in the portion to be formed into the ridge and a minimum decrease rate of sheet thickness near the base of the flange in the vicinity of the end of the ridge 12*a* or 12*b* to be formed. In FIG. 6, the pressed extent is also represented by the pressing angle as is in FIG. 5. As shown in FIG. 6, when the portion to be formed into the ridge is not restrained, a minimum decrease rate of sheet thickness near the base of the flange is approximately −65%, which apparently leads to wrinkling generation. In contrast, when restraining with a pressing angle of 23° or more, in other words, restraining the ridge region of at least ⅓ of the perimeter length of the cross section starting from the border, a minimum decrease rate of sheet thickness near the base of the flange is suppressed to −35% or less. Accordingly, this shows that wrinkling near the base of the flange is reduced.

Subsequently, as the first die 32 moves further toward the first punch 31, the first punch 31 and the first die 32 carry out a first stage press forming with the forming material 33 being restrained by the first pad 34-1 and the second pad 34-2, as illustrated in FIG. 7. By doing so, the forming material 33 is press formed into the intermediate product except, for example, the portion located below the second pad 34-2 in the pressing direction (33A in FIG. 7).

The first stage press forming using the first punch 31 and the first die 32 may be bending forming in which the first die 32 presses and bends the forming material 33 against the first punch 31. Alternatively, the first stage press forming may be deep drawing in which the first die 32 and a blank holder move toward the first punch 31 to carry out press forming while the first die 32 and the blank holder clamp the portions to be formed into the vertical walls in the forming material 33.

At this time, the second pad 34-2 is restraining the region in the vicinity of the end of the portion to be formed into each ridges 12*a*, 12*b* (near the border between the ridge 12*a* or 12*b* and the outward continuous flange 16) so that wrinkling generation is reduced in the region. In addition, because of the second pad 34-2 restraining this region, the stretch flanging rate of the flange that is continuously formed in the end of each ridge 12*a*, 12*b* is reduced, which enables reduction in cracking generation in the outward continuous flange 16. Incidentally, although not shown in FIGS. 3 to 7, a part of the curved sections 14*a*, 14*b* and the flanges 15*a*, 15*b* in the press-formed product 10 illustrated by way of example in FIG. 1 are press formed by the first punch 31 and the first die 32 in the first step.

Now, there will be described below a reason why wrinkling near the base of the flange in the end region of the ridge 12*a* or 12*b* and cracking in the edge of the outward continuous flange 16 are reduced by using the method for manufacturing a press-formed product according to the present embodiment. FIG. 8 is a view for explaining the press forming that uses a pad 134 in which the first pad and the second pad are not separated so that the portion to be formed into the gutter bottom and the portions to be formed into the ridges are restrained simultaneously. The press-formed product to be formed is shaped as a press-formed product having a widening-toward-end shape as illustrated in FIG. 1 (*a*). FIG. 8 (*a*), which corresponds to FIG. 4 (*b*), is a perspective view illustrating a state in which a punch 131 and the pad 134 are restraining the portion to be formed into the gutter bottom and the portions to be formed into the ridges in a forming material 133. In addition, FIG. 8 (*b*) is a view in which the forming material 133 is being pressed by the die, which is viewed from above.

In the case of using the pad 134, when the pad 134 presses and restrains the forming material 133 against the punch 131, the portions to be formed into the ridges are first pressed by the pad 134. In this state, a gap is created between the portion to be formed into the gutter bottom and the pad 134, and the portion to be formed into the gutter bottom is not pressed by the pad. In addition, the press-formed product having the widening-toward-end shape has different perimeter lengths of cross sections depending on the locations in the longitudinal direction in the vicinity of the end of the portion to be formed into the gutter bottom. In other words, the perimeter length of the cross section at the location $Z_1$ is longer than that at the location $Z_2$ as illustrated in FIG. 8 (*a*).

As a result, the steel sheet material for the portion to be formed into the outward flange is moved from the portion to be formed into the gutter bottom toward the portions to be formed into the ridges, until the pad 134 restrains both portions to be formed into the gutter bottom and to be formed into the ridges together, as illustrated in FIG. 8 (*a*).

Moreover, in the case of the press-formed product having a widening-toward-end shape, the portions to be formed into vertical walls, which are bent by the die, is bent in the vertical direction relative to a portion 112 to be formed into the ridges, in other words, bent in a direction of moving away from a portion 116 to be formed into the outward flange, as illustrated in FIG. 8 (*b*). This makes the steel sheet material for the portion to be formed into the outward flange easier to move toward the portion to be formed into the ridges. Consequently, this tends to cause excessive wrinkling and thickening in the portion to be formed into the ridges. For the reasons, in the case of using the pad 134 that simultaneously restrains the portion to be formed into the gutter bottom and the portions to be formed into the ridges, the wrinkling tends to occur in the end of the portion to be formed into the gutter bottom and in the end of the portions to be formed into the ridges.

In contrast, according to the present embodiment, the second pad 34-2 presses and restrains the ends of the portions to be formed into the ridges after the first pad 34-1 restrains the portion to be formed into the gutter bottom as illustrated in FIGS. 3 (*b*) and 4 (*b*). Accordingly, while the ends of the portions to be formed into the ridges are pressed by the second pad 34-2, the movement of the steel sheet material toward the portion to be formed into the gutter bottom is reduced. As a result, even though there exist different perimeter lengths of the cross section depending on a longitudinal location in the end of the portion to be formed into the gutter bottom (in the vicinity of the outward continuous flange), the movement of the steel sheet material for the portion to be formed into the outward continuous flange toward the portion to be formed into the gutter bottom and the portions to be formed into the ridges is reduced.

Moreover, while the portion to be formed into the gutter bottom is restrained by the first pad 34-1, the second pad 34-2 presses the end of the portion to be formed into each ridge, so that the end of the portion to be formed into each ridge is formed in the way that the steel sheet material in the pressed region is projected outward. Furthermore, according to the present embodiment, the first punch 31 and the first die 32 press form the forming material 33, while the forming material 33 is restrained by the first pad 34-1 and the second pad 34-2, as illustrated in FIG. 7. Consequently, an excessive steel sheet material movement toward the portion to be formed into the ridges is reduced. As a result, an excessive thickening and wrinkling in the end of each ridge 12*a*, 12*b* to be formed are reduced.

(2-3-2. Second Step)

As described above, after the first stage press forming has been carried out in the first step, a second stage press forming is carried out in the second step. In the first step, the portions to be formed into the vertical walls 13*a*, 13*b*, which are overlapped by the second pad 34-2, among portions below the second pad 34-2 along the pressing direction, are not formed into final shapes as the press-formed product 10. The whole portions or a part of the portions to be formed into the curved sections 14*a*, 14*b* and the flanges 15*a*, 15*a* in the press-formed product 10 may not be formed into final shapes in the first step, either.

Furthermore, a part of the portions to be formed into the ridges 12*a*, 12*b* may not be formed into final shapes in the first step either, depending on the region that the first pad 34-1 and the second pad 34-2 press in the forming material 33. For example, when the second pad 34-2 forms a region of ⅓ of the perimeter length of the cross section in the portion to be formed into the ridge 12*a* or 12*b* starting from the border between the portion to be formed into the ridge 12*a* or 12*b* and the portion to be formed into the gutter bottom 11 in the first step, the remaining region of ⅔ of the perimeter length of the cross section needs to be pressed later.

Accordingly, the second punch and the second die in the second step using the second press-forming apparatus carry out the second stage press forming to press the intermediate product and form the press-formed product 10 having the final shape. The second step can be carried out by the known press forming method using the second punch and the second die that have press surfaces corresponding to portions to be formed into the final shapes. If the second step does not complete forming into the final shape of the press-formed product 10, another forming step may be further added.

Incidentally, the second step may be stamping press forming using only a die and punch without using pads, or may be typical press forming using pads.

3. Conclusion

As described above, in accordance with the method for manufacturing a press-formed product, which includes the press-forming apparatus (the first press-forming apparatus) 30 and the first step using the first press-forming apparatus 30 according to the present embodiment, there is obtained the press-formed product having the outward continuous flange formed from the gutter bottom to vertical walls in the end in the predetermined direction. In the first step, the first pad restrains at least a part of the portion to be formed into the gutter bottom, and then the second pad restrains at least a part of the end of the portion to be formed into each ridge. Further in the first step, the die and punch press form the forming material with the forming material being restrained by the first and second pads.

In this way, the movement of the steel sheet material, from the portion to be formed into each ridge toward the portion to be formed into the gutter bottom, is reduced while the portion to be formed into each ridge is pressed by the second pad. In addition, the second pad forms the shape of the ridge in the end of the portion to be formed into each ridge by projecting the material in the pressed region outward. Accordingly, even though the press-formed product made of a high-tensile steel sheet having a tensile strength of 390 MPa or more is forming, the movement of the material surrounding the region that is contacted by the second pad is reduced, and thus the stretch or shrinkage deformation of the surrounding material are also reduced, which otherwise causes cracking and wrinkling.

As a result, the generation of cracking of stretched flange in the flange portion corresponding to each ridge in the outward continuous flange and wrinkling near the base of the flange in the vicinity of the end of the ridge can be reduced. The method for manufacturing a press-formed product and the press-forming apparatus are especially effective in manufacturing a press-formed product having a widening-toward-end shape in which the width of the gutter bottom or the height of the vertical walls gradually increases toward the end having the outward continuous flange. Structural members for an automotive body constituted by the press-formed product formed in this way can improve the rigidity and the property of transferring an impact load.

A preferred embodiment has been described so far with reference to the accompanied drawings. The present invention, however, is not limited to above-described example. It will be evident that those skilled in the art to which the present invention pertains may conceive various alternatives and modifications while remaining within the scope of the technical idea as described in the claims. It should be understood that such alternatives and modifications apparently fall within the technical scope of the present invention.

For example, in the above-described embodiment, the method for manufacturing a press-formed product and the press-forming apparatus have been described using the exemplary press-formed product 10 having a widening-toward-end shape and an outward continuous flange. However, the press-formed product to be manufactured according to the present invention is not limited to that example. The present invention can also be applied to a press-formed product that has a constant-width gutter bottom and constant-height vertical walls and does not have a widening-toward-end shape.

EXAMPLE(S)

Examples of the present embodiment will now be described.

(1) Example 1 and Comparative Examples 1, 2

First, a decrease rate of sheet thickness in the end of the ridge in a press-formed product 10 manufactured according to the method for manufacturing a press-formed product of the present embodiment was evaluated. In Example 1, a press-formed product was manufactured using the first pad 34-1 and the second pad 34-2 according to the method for manufacturing a press-formed product of the present embodiment. In Comparative Example 1, a press-formed product was also manufactured with the same conditions as in Example 1, except for using a pad that restrained only a gutter bottom instead of using the first pad and the second pad. Further, in Comparative Example 2, a press-formed product was manufactured with the same conditions as in Example 1, except for using a pad that restrained the gutter bottom and the ridges simultaneously instead of using the first pad and the second pad.

The forming material 33 used was a 1.4 mm thick steel sheet having a tensile strength of 980 MPa class measured by tensile testing in accordance with JIS Z 2241. In addition, a press-formed product had a substantially gutter-shaped cross section of 100 mm in height, 76 mm in gutter bottom width $L_1$, and 148 mm in gutter bottom width $L_2$, and an outward continuous flange of 14 mm in flange width. The shoulders of a punch used had a curvature radius of 12 mm.

FIG. 9 is a schematic view showing analytical results on the decrease rate of sheet thickness for the press-formed products of Example 1 and Comparative Examples 1, 2. FIG. 9 (*a*) is a view showing an analysis region A where the decrease rate of sheet thickness was analyzed. In FIG. 9 (*a*), a half of the press-formed product 10, which is divided in half at the center line along the axial direction (x direction), is shown. FIG. 9 (*b*) shows an analytical result on the press-formed product according to Comparative Example 1, and FIG. 9 (*c*) shows an analytical result on the press-formed product according to Comparative Example 2. FIG. 9 (*d*) shows an analytical result on the press-formed product 10 according to Example 1. For the analyses, LS-DYNA, a general-purpose analysis software application, was used.

The press-formed product according to Comparative Example 1, which used the pad restraining only the gutter bottom, exhibited a decrease rate of sheet thickness of 24.8% at a location I in the flange formed continuing to the end of a ridge in the outward continuous flange, as shown in FIG. 9 (*b*). This decrease rate of sheet thickness raises the concern of generating forming defects (cracking). The press-formed product according to Comparative Example 2, which used the pad restraining the gutter bottom and the ridges simultaneously, exhibited a low decrease rate of sheet thickness of 11.2% at a location H1 in the flange formed continuing to the end of a ridge in the outward continuous flange, as shown in FIG. 9 (*c*). On the other hand, the press-formed product according to Comparative Example 2 exhibited a decrease rate of sheet thickness of −15.5% at a location 112 in the curved rising surface between the end of the ridge and the outward continuous flange, as shown in FIG. 9 (*c*), which raises the concern of generating wrinkling and thickening beyond tolerance.

In contrast, the press-formed product according to Example 1, which used the first pad and the second pad, exhibited a decrease rate of sheet thickness of 15.4% at a location J1 in the flange formed continuing to the end of a ridge in the outward continuous flange 16 as shown in FIG. 9 (*d*), which was within tolerance. Moreover, a decrease rate of sheet thickness was −13.9% at a location J2 in the curved rising surface between the end of the ridge and the outward continuous flange 16 as shown in FIG. 9 (*d*), with which the generation of wrinkling and thickening were within tolerance.

(2) Example 2 and Comparative Examples 3, 4

An axial load generated in an impact event and an impact energy absorption amount were evaluated by exerting an impact load, in the axial direction, on the end having an outward continuous flange 16 in the press-formed product 10 manufactured according to the method for manufacturing a press-formed product of the present embodiment. Properties of the press-formed product having the widening-toward-end shape and the outward continuous flange, which was preferably manufactured by using the method for manufacturing a press-formed product and the press-forming apparatus according to the present embodiment, were evaluated.

FIG. 10 is a schematic view illustrating analytical models of structural member used in the analyses. FIG. 10 (*a*) illustrates an analytical model 50 according to Comparative Example 3, and FIG. 10 (*b*) illustrates an analytical model 60 according to Comparative Example 4. FIG. 10 (*c*) illustrates an analytical model 70 according to Example 2. In each analytical model 50, 60, 70, a press-formed product 10, 51, or 61, which is a first member having a substantially gutter-shaped cross section, is joined to a flat-plate second member 18 via flanges 26 that continue to vertical walls 41 through curved sections 27.

The analytical model 50 according to Comparative Example 3 has, in an axial end, an outward continuous flange 23 without having notches. In addition, the analytical model 50 has a shape in which the width of the gutter bottom and the height of the vertical walls are constant (the width of the gutter bottom=100 mm). The press-formed product 51 of the analytical model 50 is formed by press forming with the pad (pad 134 in FIG. 8 (*a*)) that simultaneously restrains the portion to be formed into the gutter bottom and the portions to be formed into the ridges.

The analytical model 60 according to Comparative Example 4 has, in an axial end, a discontinuous outward flange 24 having notches that reach the end of the ridge 25*b*. In addition, the analytical model 60 has a shape in which the width of the gutter bottom gradually increases toward the end having the outward flange 24. A minimum width of the gutter bottom is 100 mm and a maximum width is 130 mm. The press-formed product 61 of the analytical model 60 is formed by press forming with the pad that restrains only the portion to be formed into the gutter bottom.

The analytical model 70 according to Example 2 has, in an axial end, an outward continuous flange 16 without having notches. In addition, the analytical model 70 has a shape in which the width of the gutter bottom gradually increases toward the end having the outward flange 24, which is the same as in Comparative Example 4 (the width of the gutter bottom is increased from 100 mm to 130 mm). The press-formed product 10 of the analytical model 70 is formed by press forming with the first pad 34-1 and the second pad 34-2 as illustrated in FIGS. 3 to 7.

Analysis conditions other than the foregoing were all set the same for the analytical models 50, 60, 70. The common analytical conditions are listed as follows:

Steel sheet used: a 1.4 mm thick high-tensile steel sheet having a tensile strength of 980 MPa class Height of substantially gutter-shaped cross section: 100 mm Curvature radius of ridge: 12 mm Curvature radius of curved section 27 continuing to flange 26: 5 mm Widths of outward continuous flange 16 and outward flange 24: 14 mm Curvature radius r of curved rising surface 28: 3 mm Length in the axial direction: 300 mm In performing analysis, as illustrated in FIG. 10 (*a*), a rigid wall 29 was made to collide, in the axial direction at a collision speed of 20 km/h, against the end formed with the outward continuous flange 16, 23 or the outward flanges 24 to cause axial displacement in each analytical model 50, 60, 70. The axial load (kN) generated in the collision and the impact energy absorption amount (kJ) were then calculated for each of Example 2 and Comparative Examples 3, 4.

FIG. 11 is a graph showing analytical results on the axial load for each of the analytical model 50, 60, 70. It should be noted that the vertical axis of the graph in FIG. 11 represents the value that the axial load is divided by the perimeter length of the cross section (axial load/perimeter length: kN/mm) in the axial end (at the location C in FIG. 1 (*b*)) in order to exclude the influence of the perimeter length of the cross section of the end of each analytical model 50, 60, 70. In this case, the perimeter length of the cross section means the length at the center of the sheet thickness of the cross section of each press-formed product 10, 51, 61, in which the second member 18 was excluded.

In an initial region S1 of axial crushing in which a crush stroke is 5 mm or less, the analytical models 50, 70 of Example 2 and Comparative Example 3, which have the outward continuous flange 16 or 23 without having notches, have exhibited higher axial loads (kN/mm) than that of the analytical model 60 of Comparative Example 4 having the outward flange 24 that has notches. In the region S2 in which the crush stroke is exceeding 5 mm, the analytical models 60, 70 of Example 2 and Comparative Example 4 having widening-toward-end shapes have exhibited roughly higher axial loads (kN/mm) than that of the analytical model 50 of Comparative Example 3 having the constant gutter bottom width and constant vertical wall height.

In particular, the analytical model 70 according to Example 2, which includes the press-formed product 10 having the widening-toward-end shape and the outward continuous flange 16, has exhibited a high axial load from the initial stage to the late stage of the axial crushing. In particular, the analytical model 70 according to Example 2 has maintained a high axial load also in the later stage of axial crushing in which the crush stroke exceeds 15 mm.

In addition, FIG. 12 is a graph showing analytical results on the impact energy absorption amount (E.A.) for each analytical model 50, 60, 70. FIG. 12 (*a*) shows analytical results at a crush stroke of 10 mm, and FIG. 12 (*b*) shows analytical results at a crush stroke of 20 mm.

As shown in FIG. 12 (*a*), the impact energy absorption amount at a crush stroke of 10 mm is shown to be increased for each analytical model 50, 70 having the outward continuous flange 16 or 23 that has no notch at the axial end, as compared to the analytical model 60 having the outward flange 24 that has notches. Moreover, as shown in FIG. 12 (*b*), the impact energy absorption amount at a crush stroke of 20 mm is shown to be increased for the analytical model 60, 70 having the widening-toward-end shape, as compared to the analytical model 50 having the constant gutter bottom width and constant vertical wall height.

As shown in the foregoing, the load transfer property of the analytical model 70 according to Example 2 is such that the impact energy absorption property is superior, in either of the initial stage or the late stage of the collision, to those of the analytical model 50 according to Comparative Example 3 and the analytical model 60 according to Comparative Example 4.

(3) Analysis (3-1) Axial Load

Causes of the axial load becoming high in the analytical model 70 according to Example 2 were analyzed using the above-described analytical models 50, 60, 70 of Comparative Examples 3, 4 and Example 2. FIGS. 13 (*a*) to 13 (*c*) show stress distributions in the axial direction (X direction) at a crush stroke of 5 mm in the analytical model 50 according to Comparative Example 3, the analytical model 60 according to Comparative Example 4, and the analytical model 70 according to Example 2. In FIGS. 13 (*a*) to 13 (*c*), darker color represents larger stress. In addition, FIGS. 14 (*a*) to 14 (*c*) show the distributions of out-of-plane displacement at a crush stroke of 5 mm in the height direction (Z direction) in the analytical model 50 according to Comparative Example 3, the analytical model 60 according to Comparative Example 4, and the analytical model 70 according to Example 2. In FIGS. 14 (*a*) to 14 (*c*), darker color represents larger concave displacement and lighter color represents larger convex displacement.

As shown in FIG. 13 (*b*), stress is concentrated in the ridges 25*a*, 25*b* on the side of the end to which an impact load is applied in the analytical model 60 according to Comparative Example 4, and the load cannot be sufficiently transferred to the opposite ends of the ridges 25*a*, 25*b*. In contrast, in the analytical model 70 according to Example 2, a relatively large stress is produced in the ridges 25*a*, 25*b*, and is distributed relatively uniformly over the whole ridges 25*a*, 25*b*, as shown in FIG. 13 (*c*). It should be noted that, in the analytical model 50 according to Comparative Example 3, the stress produced in the ridges 25*a*, 25*b* is distributed relatively uniformly over the whole ridges 25*a*, 25*b*, as shown in FIG. 13 (*a*).

In addition, in the analytical model 50 according to Comparative Example 3, a relatively large out-of-plane displacement (concave and convex) is generated in the gutter bottom 53 at distant locations from the end to which an impact load is applied, as shown in FIG. 14 (*a*). In addition, a buckling start point P is generated at a location further distant from the end to which an impact load is applied than the location in which out-of-plane displacement occurred. In addition, in the analytical model 60 according to Comparative Example 4, an excessive out-of-plane displacement (−8.3 mm) is generated in the end 63*a* of the gutter bottom 63 (in the vicinity of the outward flange 24), as shown in FIG. 14 (*b*). In contrast, in the analytical model 70 according to Example 2, an out-of-plane displacement (−7.7 mm) is generated in the end 11*a* of the gutter bottom 11 (in the vicinity of the outward continuous flange 23), but the degree of the out-of-plane displacement is smaller than that in the analytical model 60 according to Comparative Example 4, as shown in FIG. 14 (*c*).

As described above, in the analytical model 70 having the widening-toward-end shape and the outward continuous flange, stress is not concentrated, in case of an impact event, in the ends of the ridges 25*a*, 25*b* in the vicinity of the outward continuous flange 16 but is distributed relatively uniformly over the opposite ends. Moreover, the analytical model 70 properly deforms in the end 11*a* of the gutter bottom 11 in the vicinity of the outward continuous flange 16. Consequently, in the analytical model 70 according to Example 2, the axial load becomes high in both of the initial stage and the late stage of axial crushing, as shown in FIG. 11.

(3-2) Impact Energy Absorption Amount

Causes of the impact energy absorption amount becoming large in the analytical model 70 according to Example 2 were analyzed using the above-described analytical models 50, 60, 70 of Comparative Examples 3, 4 and Example 2.

FIGS. 15 (*a*) to 15 (*c*) show the distributions of equivalent plastic strain at a crush stroke of 5 mm in the analytical model 50 according to Comparative Example 3, the analytical model 60 according to Comparative Example 4, and the analytical model 70 according to Example 2. FIGS. 16 (*a*) to 16 (*c*) also show the distributions of equivalent plastic strain at a crush stroke of 10 mm in the analytical model 50 according to Comparative Example 3, the analytical model 60 according to Comparative Example 4, and the analytical model 70 according to Example 2.

In addition, FIGS. 17 (*a*) to 17 (*c*) show the distributions of equivalent plastic strain at a crush stroke of 15 mm in the analytical model 50 according to Comparative Example 3, the analytical model 60 according to Comparative Example 4, and the analytical model 70 according to Example 2. Furthermore, FIGS. 18 (*a*) to 18 (*c*) show distributions of equivalent plastic strain at a crush stroke of 20 mm in the analytical model 50 according to Comparative Example 3, the analytical model 60 according to Comparative Example 4, and the analytical model 70 according to Example 2.

As shown in FIGS. 15 (*a*) and 16 (*a*), in the analytical model 50 according to Comparative Example 3, first buckling has started at a crush stroke of 10 mm at a location E1 distant from the end to which an impact load is applied. Vulnerability to buckling also depends on the width of the gutter bottom. It can be seen that the first buckling does not necessarily start from the end to which an impact load is applied when the width of the gutter bottom 53 is constant as in the analytical model 50. This corresponds to the fact that a large out-of-plane displacement is generated at a distant location from the end to which an impact load is applied in above-described FIG. 14 (*a*).

Moreover, in the analytical model 50 according to Comparative Example 3, as the crush stroke becomes larger, a new buckling occurs at a location E2 that is further distant from the end to which an impact load is applied, as shown in FIG. 17 (*a*). Furthermore, FIG. 18 (*a*) shows that buckling occurs, at a crush stroke of 20 mm, at three locations (E1 to E3) in a wide area that is distant from the end to which an impact load is applied.

In contrast, as shown in FIGS. 15 (*c*) and 16 (*c*), the analytical model 70 according to Example 2, in which the end side to which an impact load is applied is most vulnerable to buckling because of having the outward continuous flange 16 and the widening-toward-end shape, has started buckling at a location G1 that is closer to the end. Subsequently, as shown in FIG. 17 (*c*), the width of the gutter bottom 11 at the location G1 becomes narrower gradually, which leads to second buckling at the location G2 that is adjacent to the location G1 in which the first buckling occurred. This step repeats thereafter. As shown above, the buckling pitch becomes narrower and the number of buckling portions increases, which leads to an increase in the impact energy absorption amount at a crush stroke of more than 5 mm in the analytical model 70 according to Example 2. Consequently, buckling has occurred at three locations (G1 to G3) at a crush stroke of 20 mm in an area closer to the end to which an impact load is applied, as shown in FIG. 18 (*c*).

Incidentally, as shown in FIGS. 15 (*b*), 16 (*b*), 17 (*b*), and 18 (*b*), the analytical model 60 according to Comparative Example 4 has generated buckling at locations relatively near the end to which an impact load is applied because it also has the widening-toward-end shape. As shown in FIG. 18 (*b*), buckling has occurred at two locations (F1 and F2) in an area relatively close to the end to which an impact load is applied at a crush stroke of 20 mm. Accordingly, the impact energy absorption property has been shown relatively better.

As described in the foregoing, the analytical model 70, which includes the press-formed product 10 having the outward continuous flange 16 and the widening-toward-end shape, is made to increase the axial load in the initial stage and the late stage of axial crushing. In addition, the analytical model 70 generates buckling with small buckling pitch therebetween near the end to which an impact load is applied. Accordingly, the analytical model 70 is shown to have excellent load transfer property and excellent impact energy absorption property. The method for manufacturing a press-formed product and the press-forming apparatus according to the present invention can reduce cracking generation in the edge of the outward continuous flange 16 and wrinkling generation near the base of the flange in the ends of the ridges 12*a*, 12*b*, in manufacturing the press-formed product 10 that constitutes the aforementioned analytical model 70.

REFERENCE SIGNS LIST

10 press-formed product
11 gutter bottom
12*a*, 12*b* ridge
13*a*, 13*b* vertical wall
14*a*, 14*b* curved section
15*a*, 15*b* flange
16 outward continuous flange
18 second member
30 press-forming apparatus (the first press-forming apparatus)
31 punch (first punch)
32 die (first die)
33 forming material
34-1 first pad
34-2 second pad
100 structural member

The invention claimed is:

1. A method of manufacturing a press-formed product by press forming a forming material made of a high-tensile strength steel sheet of 390 MPa or more, the press-formed product extending in a predetermined direction, having a substantially gutter-shaped cross section intersecting the predetermined direction, and including a gutter bottom,
a ridge connected to the gutter bottom,
a vertical wall connected to the ridge, and
an outward continuous flange being continuously formed along at least the gutter bottom and the ridge in at least one end in the predetermined direction, the method comprising:

a first step in which,
by using a first press-forming apparatus including a first punch, a first die, a first pad, and a second pad, the both pads facing the first punch,
the first pad presses at least a part of a portion to be formed into the gutter bottom of the forming material to press the forming material against the first punch in a manner that an end of the forming material connected to the portion to be formed into the gutter bottom is raised in a direction opposite to a pressing direction and at least a part of the portion to be formed into the gutter bottom is restrained by the first pad and the first punch, and the second pad subsequently presses at least a part of an end in the predetermined direction of a portion to be formed into the ridge against the first punch in a manner that the end in the predetermined direction connected to the portion to be formed into the ridge is raised in the direction opposite to the pressing direction and the portion to be formed into the ridge is bent in the pressing direction, and simultaneously, at least the part of the portion to be formed into the ridge is restrained by the second pad and the first punch, and the first punch and the first die carry out press forming to form an intermediate product while the forming material is restrained by the first pad and the second pad; and a second step in which, by using a second press-forming apparatus including a second punch and a second die, the second punch and the second die press form the intermediate product to form the press formed product.

2. The method for manufacturing the press-formed product according to claim 1, wherein, in the first step, the second pad presses, against the first punch, a portion of at least ⅓ the length of a perimeter of a cross section in the portion to be formed into the ridge starting from a border between the portion to be formed into the ridge and the portion to be formed into the gutter bottom.

3. The method for manufacturing the press-formed product according to claim 1, wherein the first pad and the second pad are supported by the first die, and the first pad, the second pad, and the first die consecutively press the forming material in this order while the first die is moved toward the first punch.

4. The method for manufacturing the press-formed product according to claim 1, wherein the press forming in the first step is bending forming.

5. The method for manufacturing the press-formed product according to claim 1, wherein the press forming in the first step is deep drawing.

6. The method for manufacturing the press-formed product according to claim 1, wherein the press-formed product is a formed product in which at least one of a width of the gutter bottom and a height of the vertical wall gradually increases toward the end having the outward continuous flange.

7. A press-forming apparatus used for manufacturing a press-formed product extending in a predetermined direction, having a substantially gutter-shaped cross section intersecting the predetermined direction, and including a gutter bottom, a ridge connected to the gutter bottom, a vertical wall connected to the ridge, and an outward continuous flange being continuously formed along at least the gutter bottom and the ridge in at least one end in the predetermined direction, the press-forming apparatus comprising:

a punch;

a die; and a pad facing the punch, the punch and the die carrying out press forming while a forming material made of a high-tensile strength steel sheet of 390 MPa or more is restrained by the pad and the punch, wherein the pad includes a first pad, and a second pad being different from the first pad, the first pad presses and restrains at least a part of a portion to be formed into the gutter bottom of the forming material to press the forming material against the punch in a manner that an end of the forming material connected to the portion to be formed into the gutter bottom is raised in a direction opposite to a pressing direction and at least a part of the portion to be formed into the gutter bottom is restrained by the first pad and the first punch, the second pad presses at least a part of an end of an end in the predetermined direction of a portion to be formed into the ridge against the punch in a manner that the end in the predetermined direction connected to the portion to be formed into the ridge is raised in the direction opposite to the pressing direction and the portion to be formed into the ridge is bent in the pressing direction and at least the part of the portion to be formed into the ridge is simultaneously restrained by the second pad and the punch, and the second pad restrains at least the part of the portion to be formed into the ridge after the first pad restrains at least the part of the portion to be formed into the gutter bottom.

8. The press-forming apparatus according to claim 7, wherein the second pad presses a portion of at least ⅓ the length of a perimeter of a cross section in the portion to be formed into the ridge starting from a border between the portion to be formed into the ridge and the portion to be formed into the gutter bottom.

9. The press-forming apparatus according to claim 7, wherein the first pad and the second pad are supported by the die, and the first pad, the second pad, and the die consecutively press the forming material in this order while the die is moved toward the punch.

* * * * *